US008644531B2

(12) United States Patent
Kon et al.

(10) Patent No.: US 8,644,531 B2
(45) Date of Patent: Feb. 4, 2014

(54) INFORMATION PROCESSING SYSTEM AND INFORMATION PROCESSING METHOD

(75) Inventors: Homare Kon, Tokyo (JP); Yuji Yamada, Tokyo (JP)

(73) Assignee: Sony Corporation, Tokyo (JP)

( * ) Notice: Subject to any disclaimer, the term of this patent is extended or adjusted under 35 U.S.C. 154(b) by 342 days.

(21) Appl. No.: 12/634,999

(22) Filed: Dec. 10, 2009

(65) Prior Publication Data

US 2010/0150355 A1 Jun. 17, 2010

(30) Foreign Application Priority Data

Dec. 16, 2008 (JP) ..... 2008-319316

(51) Int. Cl.
*H04R 5/02* (2006.01)

(52) U.S. Cl.
USPC ..... 381/310; 381/61; 381/333; 381/306; 348/552; 345/158

(58) Field of Classification Search
USPC ..... 381/17, 309, 300, 370, 388, 306, 333, 381/61, 310, 332; 345/649, 158; 348/552
See application file for complete search history.

(56) References Cited

U.S. PATENT DOCUMENTS

| | | | | |
|---|---|---|---|---|
| 5,959,597 | A | 9/1999 | Yamada et al. | |
| 6,011,526 | A * | 1/2000 | Toyoshima et al. | 345/7 |
| 2004/0125044 | A1 * | 7/2004 | Suzuki | 345/1.1 |

FOREIGN PATENT DOCUMENTS

| | | | |
|---|---|---|---|
| EP | 1 124 175 | A2 | 8/2001 |
| EP | 1 396 781 | A2 | 3/2004 |
| JP | 09-070094 | | 3/1997 |
| JP | 09-093700 | | 4/1997 |
| JP | 10-230899 | A | 9/1998 |
| JP | 11-205892 | | 7/1999 |
| JP | 2002-209300 | A | 7/2002 |
| JP | 2006-165845 | A | 6/2006 |
| JP | 2006-186904 | A | 7/2006 |
| JP | 2006-294032 | A | 10/2006 |
| JP | 2006-295313 | A | 10/2006 |
| JP | 2008-219759 | A | 9/2008 |
| WO | WO 95/22235 | A1 | 8/1995 |
| WO | WO 2006/107074 | A1 | 10/2006 |

* cited by examiner

*Primary Examiner* — Vivian Chin
*Assistant Examiner* — Con P Tran
(74) *Attorney, Agent, or Firm* — Wolf, Greenfield & Sacks, P.C.

(57) ABSTRACT

An information processing system includes a display, a display sensor that detects a movement or a rotation of the display, a transducer unit as an earphone unit or a headphone unit, a sound processing part that processes an audio signal so as to localize a sound image in a position outside a head of a listener wearing the transducer unit and listening to sound, and an operation controller that computes an output from the display sensor to obtain a moving direction and a moving distance, or a rotation direction and a rotation angle of the display, and controls sound processing performed by the sound processing part in accordance with a result of the computation so that a positional relation between the display and the head of the listener is mapped as a positional relation between an image display surface and the head of the listener in a virtual viewing space.

22 Claims, 20 Drawing Sheets

Ho: POSITION OF LISTENER'S HEAD
Do: INITIAL POSITION OF DISPLAY
Lo: INITIAL DISTANCE BETWEEN DISPLAY AND LISTENER'S HEAD

FIG. 6

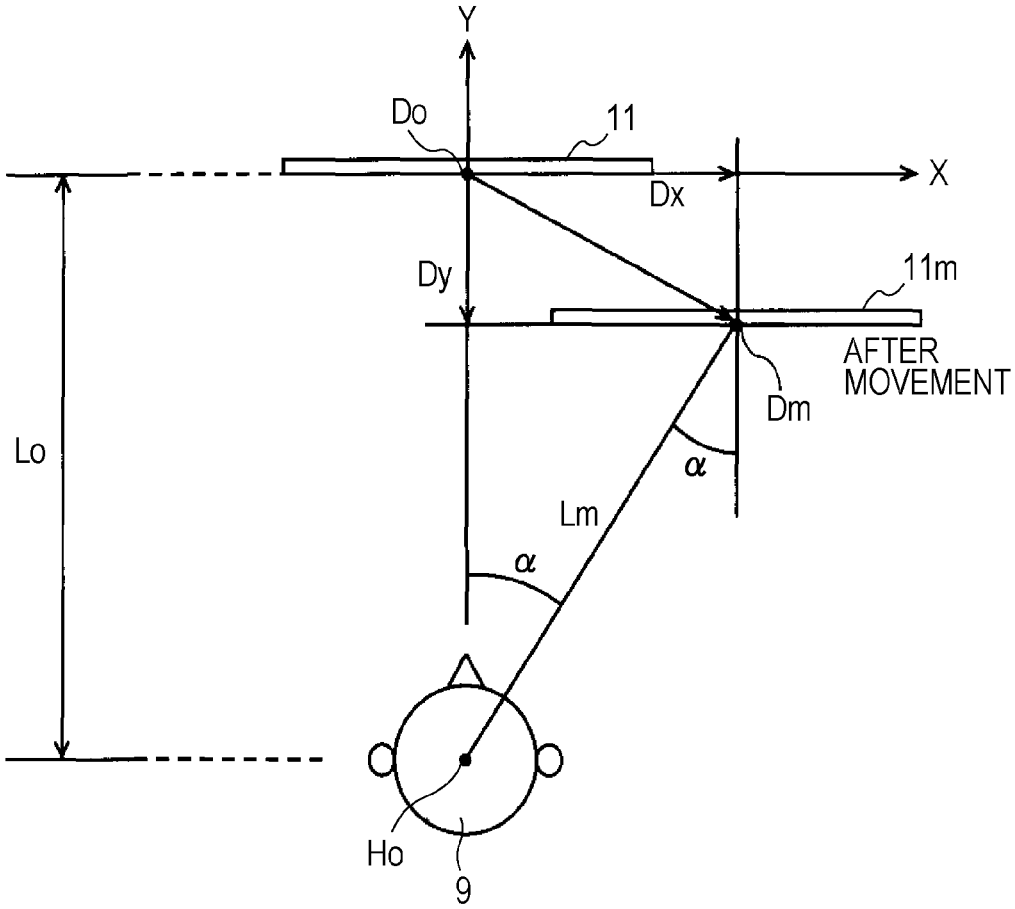

Ho: POSITION OF LISTENER'S HEAD
Do: INITIAL POSITION OF DISPLAY
Lo: INITIAL DISTANCE BETWEEN DISPLAY AND LISTENER'S HEAD
Dm: POSITION OF DISPLAY AFTER MOVEMENT
Dx: MOVING DISTANCE OF DISPLAY IN DIRECTION OF X AXIS
Dy: MOVING DISTANCE OF DISPLAY IN DIRECTION OF Y AXIS
Lm: DISTANCE BETWEEN MOVED DISPLAY AND LISTENER'S HEAD $$Lm^2 = Dx^2 + (Lo - Dy)^2 \quad \cdots(1)$$

$$\tan\alpha = Dx/(Lo - Dy) \quad \cdots(2)$$

Ho: POSITION OF LISTENER'S HEAD
Do: INITIAL POSITION OF DISPLAY
Lo: INITIAL DISTANCE BETWEEN DISPLAY AND LISTENER'S HEAD
ϕ : ROTATION ANGLE OF DISPLAY

FIG. 10

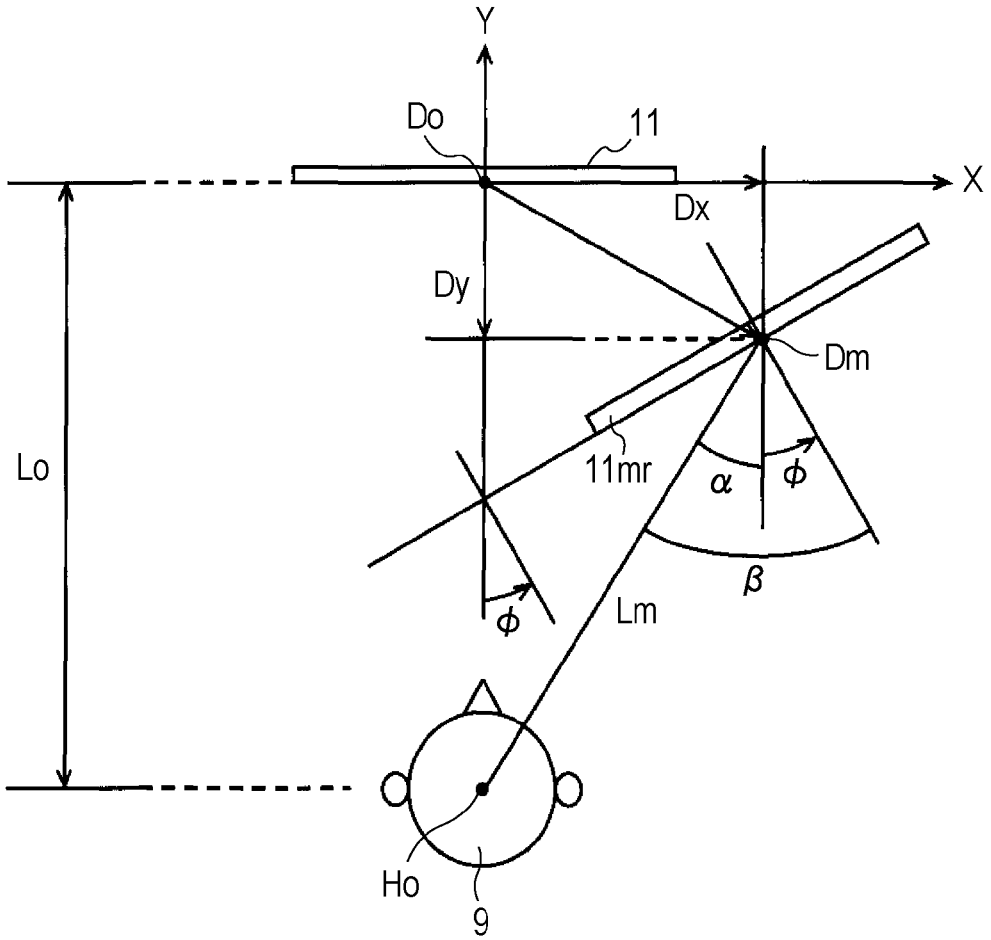

Ho: POSITION OF LISTENER'S HEAD
Do: INITIAL POSITION OF DISPLAY
Lo: INITIAL DISTANCE BETWEEN DISPLAY AND LISTENER'S HEAD
Dm: POSITION OF DISPLAY AFTER MOVEMENT
Dx: MOVING DISTANCE OF DISPLAY IN DIRECTION OF X AXIS
Dy: MOVING DISTANCE OF DISPLAY IN DIRECTION OF Y AXIS
Lm: DISTANCE BETWEEN MOVED DISPLAY AND LISTENER'S HEAD
$\phi$ : ROTATION ANGLE OF DISPLAY $$Lm^2 = Dx^2 + (Lo - Dy)^2 \quad \cdots(1)$$

$$\tan\alpha = Dx/(Lo - Dy) \quad \cdots(2)$$

FIG. 13

| | |
|---|---|
| dx[k-1] : | MOVING DISTANCE ON X AXIS AT IMMEDIATELY PREVIOUS SAMPLING |
| dy[k-1]: | MOVING DISTANCE ON Y AXIS AT IMMEDIATELY PREVIOUS SAMPLING |
| r[k-1]: | ROTATION ANGLE AT IMMEDIATELY PREVIOUS SAMPLING |
| td: | TIME INTERVAL BETWEEN SAMPLING |
| ax[k]: | ACCELERATION ON X AXIS AT PRESENT SAMPLING |
| ay[k]: | ACCELERATION ON Y AXIS AT PRESENT SAMPLING |
| dx[k]: | MOVING DISTANCE ON X AXIS AT PRESENT SAMPLING |
| dy[k]: | MOVING DISTANCE ON Y AXIS AT PRESENT SAMPLING |
| g[k]: | ANGULAR VELOCITY AT PRESENT SAMPLING |
| r[k]: | ROTATION ANGLE AT PRESENT SAMPLING |

$$Dx : dx[k] = dx[k-1] + ax[k] \times td \times td \quad \cdots(11)$$

$$Dy : dy[k] = dy[k-1] + ay[k] \times td \times td \quad \cdots(12)$$

$$\phi : r[k] = r[k-1] + g[k] \times td \quad \cdots(13)$$

FIG. 16

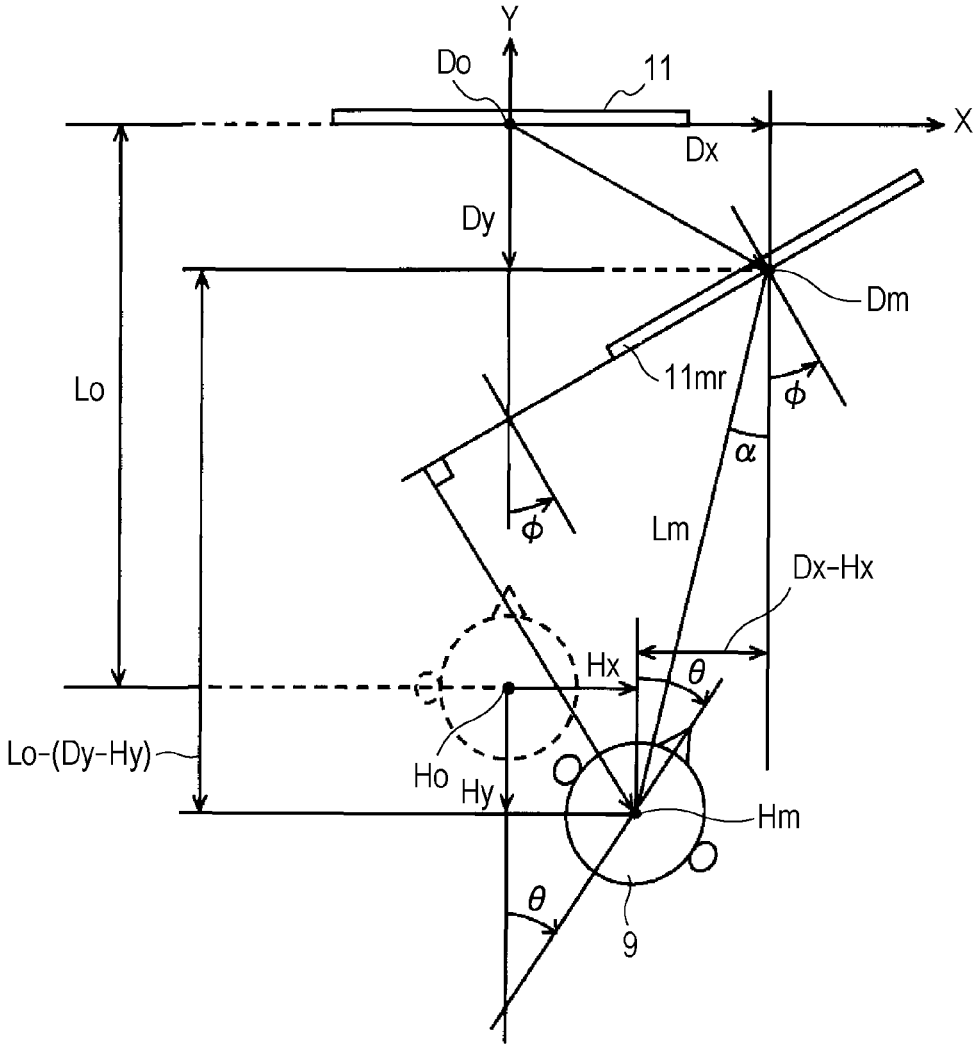

Ho: POSITION OF LISTENER'S HEAD
Hm: POSITION OF LISTENER'S HEAD AFTER MOVEMENT
Hx: MOVING DISTANCE OF LISTENER'S HEAD IN DIRECTION OF X AXIS
Hy: MOVING DISTANCE OF LISTENER'S HEAD IN DIRECTION OF Y AXIS
$\theta$ : ROTATION ANGLE OF LISTENER'S HEAD
Lm: DISTANCE BETWEEN MOVED DISPLAY AND MOVED LISTENER'S HEAD $$Lm^2 = (Dx-Hx)^2 + \{(Lo-(Dy-Hy)\}^2 \quad \cdots(3)$$

$$\tan\alpha = (Dx-Hx)/\{(Lo-(Dy-Hy)\} \quad \cdots(4)$$

FIG. 19

| | |
|---|---|
| dx[k-1] : | MOVING DISTANCE ON X AXIS AT IMMEDIATELY PREVIOUS SAMPLING |
| dy[k-1]: | MOVING DISTANCE ON Y AXIS AT IMMEDIATELY PREVIOUS SAMPLING |
| r[k-1]: | ROTATION ANGLE AT IMMEDIATELY PREVIOUS SAMPLING |
| td: | TIME INTERVAL BETWEEN SAMPLING |
| ax[k]: | ACCELERATION ON X AXIS AT PRESENT SAMPLING |
| ay[k]: | ACCELERATION ON Y AXIS AT PRESENT SAMPLING |
| dx[k]: | MOVING DISTANCE ON X AXIS AT PRESENT SAMPLING |
| dy[k]: | MOVING DISTANCE ON Y AXIS AT PRESENT SAMPLING |
| g[k]: | ANGULAR VELOCITY AT PRESENT SAMPLING |
| r[k]: | ROTATION ANGLE AT PRESENT SAMPLING |

$$Dx : dx[k] = dx[k-1] + ax[k] \times td \times td \quad \cdots(11)$$

$$Dy : dy[k] = dy[k-1] + ay[k] \times td \times td \quad \cdots(12)$$

$$\phi : r[k] = r[k-1] + g[k] \times td \quad \cdots(13)$$

$$Hx : dx[k] = dx[k-1] + ax[k] \times td \times td \quad \cdots(21)$$

$$Hy : dy[k] = dy[k-1] + ay[k] \times td \times td \quad \cdots(22)$$

$$\theta : r[k] = r[k-1] + g[k] \times td \quad \cdots(23)$$

INFORMATION PROCESSING SYSTEM AND INFORMATION PROCESSING METHOD

BACKGROUND OF THE INVENTION

1. Field of the Invention

The present invention relates to an information processing system configured to display images on a display and output sound through earphones or headphones, and an information processing method using the information processing system.

2. Description of the Related Art

It is popular to listen to sound such as music through earphones or headphones while viewing images such as video on a portable display unit.

Japanese Unexamined Patent Application Publication No. 9-70094 and Japanese Unexamined Patent Application Publication No. 11-205892 disclose a technology of detecting a rotation of the head of a listener, controlling sound image localization based on the result of the detection, and localizing the sound image in a predetermined position outside the head of the listener, when the listener is listening to music through earphones or headphones.

Furthermore, Japanese Unexamined Patent Application Publication No. 9-93700 discloses a technology of localizing the sound image in a predetermined position on a display panel when an image and sound is reproduced.

SUMMARY OF THE INVENTION

However, with the existing methods of the sound image localization described above, because it is premised that a display unit is fixedly installed without being moved, a sound image is fixedly localized in a predetermined position independently of changes in the state of a display when a listener listens to sound through earphones or headphones while viewing images on a portable display unit such as a mobile phone.

Specifically, the position in which the sound image of the sound is localized does not change even when the listener wearing the earphones or the headphones moves the display unit such as the mobile phone closer to the listener, away from the listener, or obliquely to the listener. Therefore, for example, such a realistic sensation as experienced in a theater when viewing a movie in a seat in the front, in a seat in the back, or in a seat oblique to the screen is not provided when listening to the sound using the portable display unit.

It is desirable to control the sound image localization so that the listener can experience the realistic sensation as if the listener were viewing a movie while moving from one seat to another in a theater, when the listener listens to the sound through the earphones or the headphones and views images on a portable display unit in his or her hand while moving and rotating the display unit.

An information processing system according to an embodiment of the present invention includes a display, a display sensor configured to detect a movement or a rotation of the display, a transducer unit configured as an earphone unit or a headphone unit, a sound processing part configured to process an audio signal so as to localize a sound image in a position outside a head of a listener wearing the transducer unit and listening to sound, and an operation controller configured to compute an output from the display sensor to obtain a moving direction and a moving distance, or a rotation direction and a rotation angle of the display, and to control sound processing performed by the sound processing part in accordance with a result of the computation so that a positional relation between the display and the head of the listener is mapped as a positional relation between an image display surface and the head of the listener in a virtual viewing space.

An information processing system according to another embodiment of the present invention is the information processing system according to the above embodiment, which further includes a transducer sensor attached to the transducer unit and configured to detect a movement or a rotation of the head of the listener. The operation controller is configured to compute the output from the display sensor and an output from the transducer sensor to obtain the moving direction and the moving distance, or the rotation direction and the rotation angle of the display, and the moving direction and the moving distance, or the rotation direction and the rotation angle of the head of the listener, and to control the sound processing performed by the sound processing part in accordance with a result of the computation so that the positional relation between the display and the head of the listener is mapped as the positional relation between the image display surface and the head of the listener in the virtual viewing space.

The information processing system according to the embodiments of the present invention configured as above localizes the sound image so that, in the virtual viewing space, the listener moves closer to an image display surface, away from the image display surface, or to the left or the right of the image display surface to be positioned obliquely to the image display surface, when the listener moves the display closer to the listener, away from the listener, or tilts against the listener.

Accordingly, the sound image localization provides the realistic sensation as if the listener were viewing a movie while moving from one seat to another in the theater.

Since most music sources use front speakers as main speakers, volume of the sound is increased by moving the display closer and decreased by moving the display away, and consequently the information processing system can also function as a volume adjusting interface without using operating means such as keys and switches.

As described above, according to the embodiments of the present invention, when the listener listens to the sound through the earphones or the headphones and views images on the portable display unit in his or her hand while moving and rotating the display unit, the sound image localization provides the realistic sensation as if the listener were viewing a movie while moving from one seat to another in the theater.

BRIEF DESCRIPTION OF THE DRAWINGS

FIG. 6 is a schematic diagram showing an example when a display is moved according to the embodiment;

FIG. 10 is a schematic diagram showing an example of moving and rotating the display according to the embodiment;

FIG. 13 shows an illustration used to compute a moving distance and a rotation angle according to the embodiment;

FIG. 16 is a schematic diagram showing an example of moving and rotating the display and a head of a listener according to the other embodiment;

FIG. 19 shows an illustration used to compute a moving distance and a rotation angle according to the other embodiment.

DESCRIPTION OF THE PREFERRED EMBODIMENTS

1. Embodiment

FIGS. 1 to 13

An embodiment of the present invention shows a case in which a listener does not move or rotate and only a display moves and/or rotates.

(1-1. System Configuration: FIGS. 1 to 4)

Figure 1:
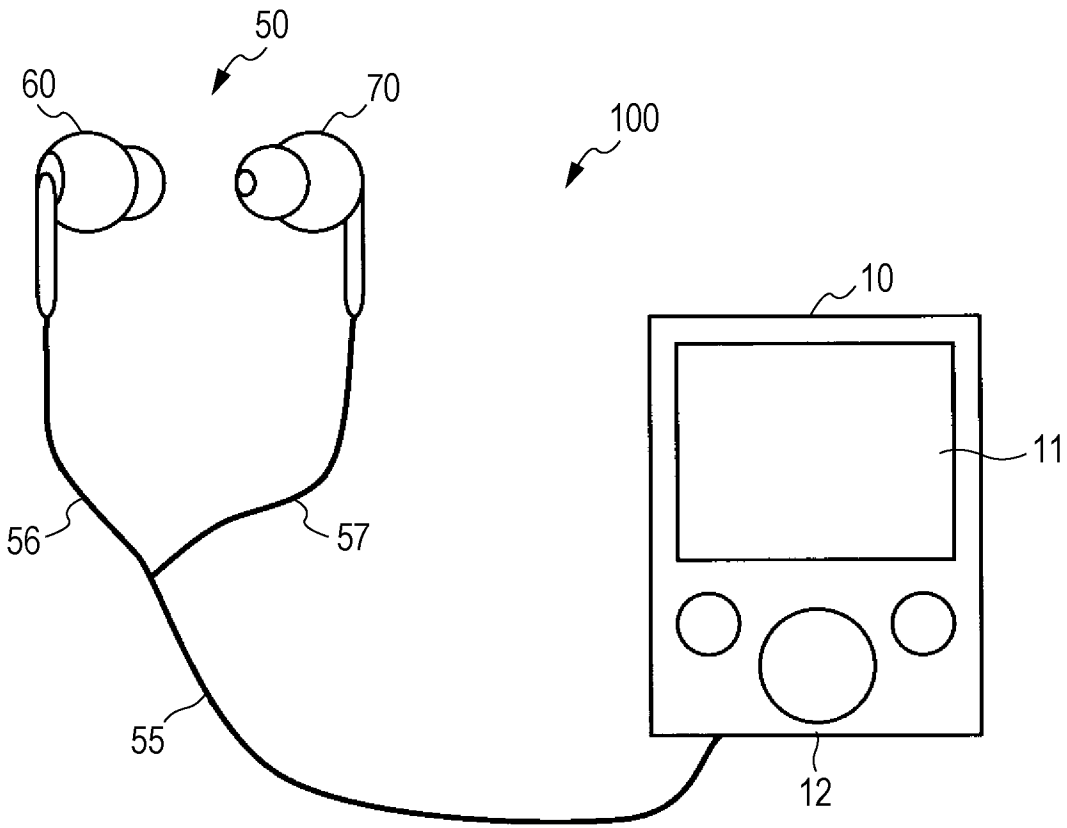
FIG. 1 is a schematic diagram of an example of the external configuration of an information processing system according to an embodiment of the present invention.

<1-1-1. External Configuration of System: FIG. 1>

FIG. 1 shows an example of the external configuration of an information processing system according to the embodiment.

An information processing system 100 shown in FIG. 1 includes an information processing unit 10 and an earphone unit 50.

The information processing unit 10 is capable of reproducing images such as video and sounds such as music, and externally includes a display 11, such as a liquid crystal display or an organic EL display, and an operation part 12 further including operation keys and an operation dial.

The earphone unit 50 includes a left earphone part 60 and a right earphone part 70, and cord sections 56 and 57 branched from an end of a cord 55 are respectively connected to the left earphone part 60 and the right earphone part 70.

Although not shown in FIG. 1, a plug is attached to the other end of the cord 55, and the plug is inserted into a socket provided in the information processing unit 10, whereby the earphone unit 50 is wired to the information processing unit 10.

Figure 2:
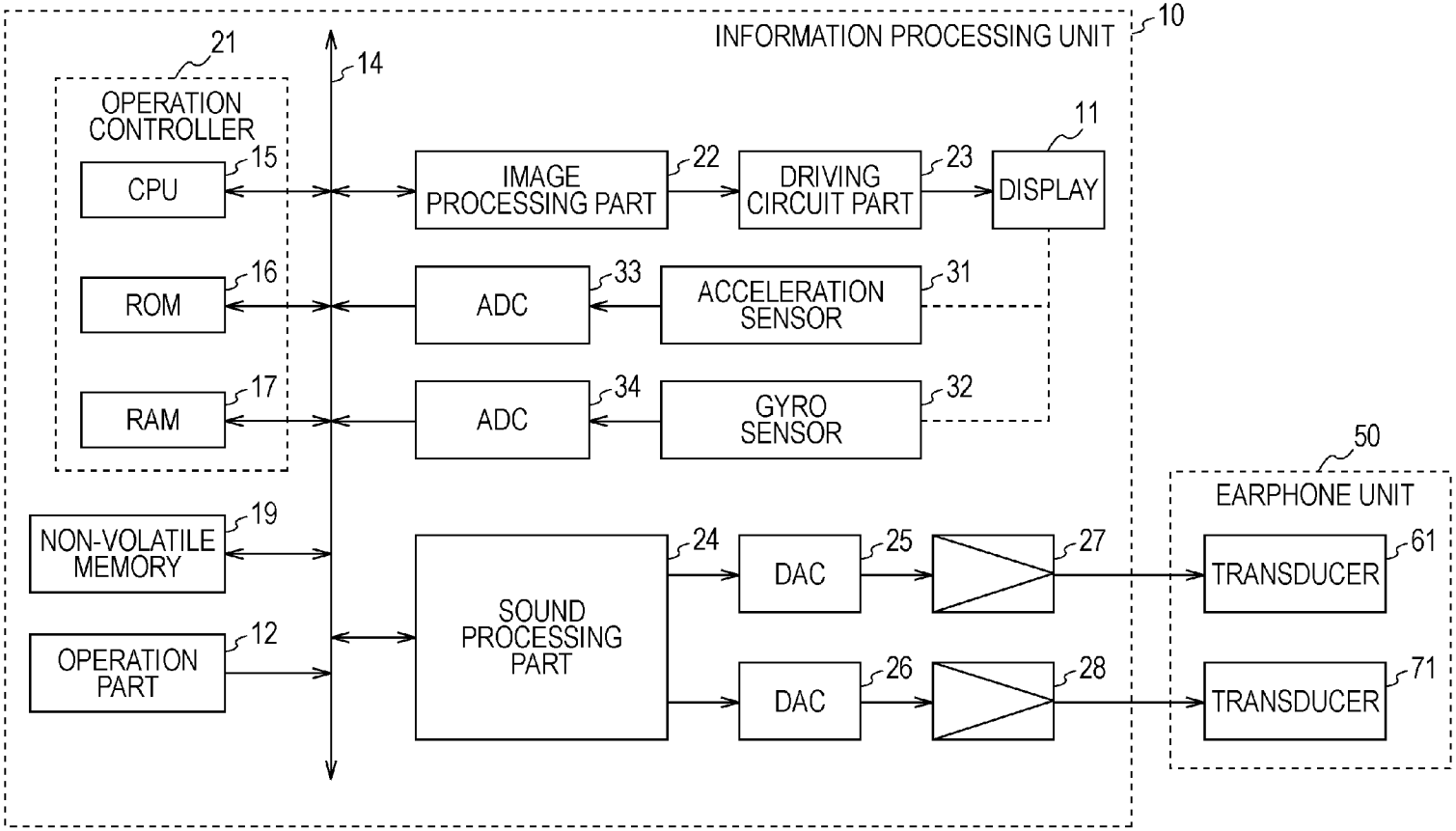
FIG. 2 is a block diagram of the connection configuration of an information processing unit according to an embodiment of the present invention.

<1-1-2. Connection Configuration of System: FIG. 2>

FIG. 2 shows a connection configuration of the information processing unit 10.

The information processing unit 10 includes a bus 14, to which not only the operation part 12 but also a central processing unit (CPU) 15, a read only memory (ROM) 16, a random access memory (RAM) 17, and a non-volatile memory 19 are connected.

Various computer programs to be performed by the CPU 15 and necessary fixed data are written on the ROM 16 in advance. The RAM 17 functions as a work area of the CPU 15.

The CPU 15, the ROM 16, and the RAM 17 form an operation controller 21 that performs computations related to a movement and a rotation of the display 11 and controls sound image localization in accordance with the result of the computation to be described later.

The non-volatile memory 19 is either incorporated in or attached to the information processing unit 10, and stores image data such as video and sound data such as music.

An image processing part 22 and a sound processing part 24, each of which includes the CPU 15, the ROM 16, and the RAM 17, are connected to the bus 14.

The image processing part 22 converts the image data such as video read from the non-volatile memory 19 into analog image signals. If the image data has been compressed, the image processing part 22 first decompresses it.

The sound processing part 24 performs sound image localization described later on the sound data such as music read from the non-volatile memory 19. If the sound data has been compressed, the sound processing part 24 first decompresses it.

The image signal from the image processing part 22 is converted into a display driving signal by a driving circuit part 23, and supplied to the display 11.

The digital sound data on both the left and the right from the sound processing part 24 are converted into analog audio signals by digital to analog converters (DAC) 25 and 26. The audio signals on both the left and the right after the conversion are amplified by audio amplifier circuits 27 and 28, and supplied to transducers 61 and 71 on the left and the right of the earphone unit 50.

The transducers 61 and 71 convert the audio signals such as music into sound.

In this example, the information processing unit 10 is also provided with an acceleration sensor 31 for detecting a movement of the display 11, i.e., a movement of the information processing unit 10, and a gyro sensor 32 for detecting a rotation of the display 11, i.e., a rotation of the information processing unit 10.

Specifically, the acceleration sensor 31 detects an acceleration of the movement in directions of two mutually orthogonal axes (X axis and Y axis) on a reference plane to be described later, and the gyro sensor 32 detects an angular velocity of the rotation around an axis perpendicular to the reference plane (Z axis).

Output signals from the acceleration sensor 31 and the gyro sensor 32 are respectively sampled by analog to digital converters (ADC) 33 and 34, converted into digital data, and transmitted to the bus 14.

Figure 3:
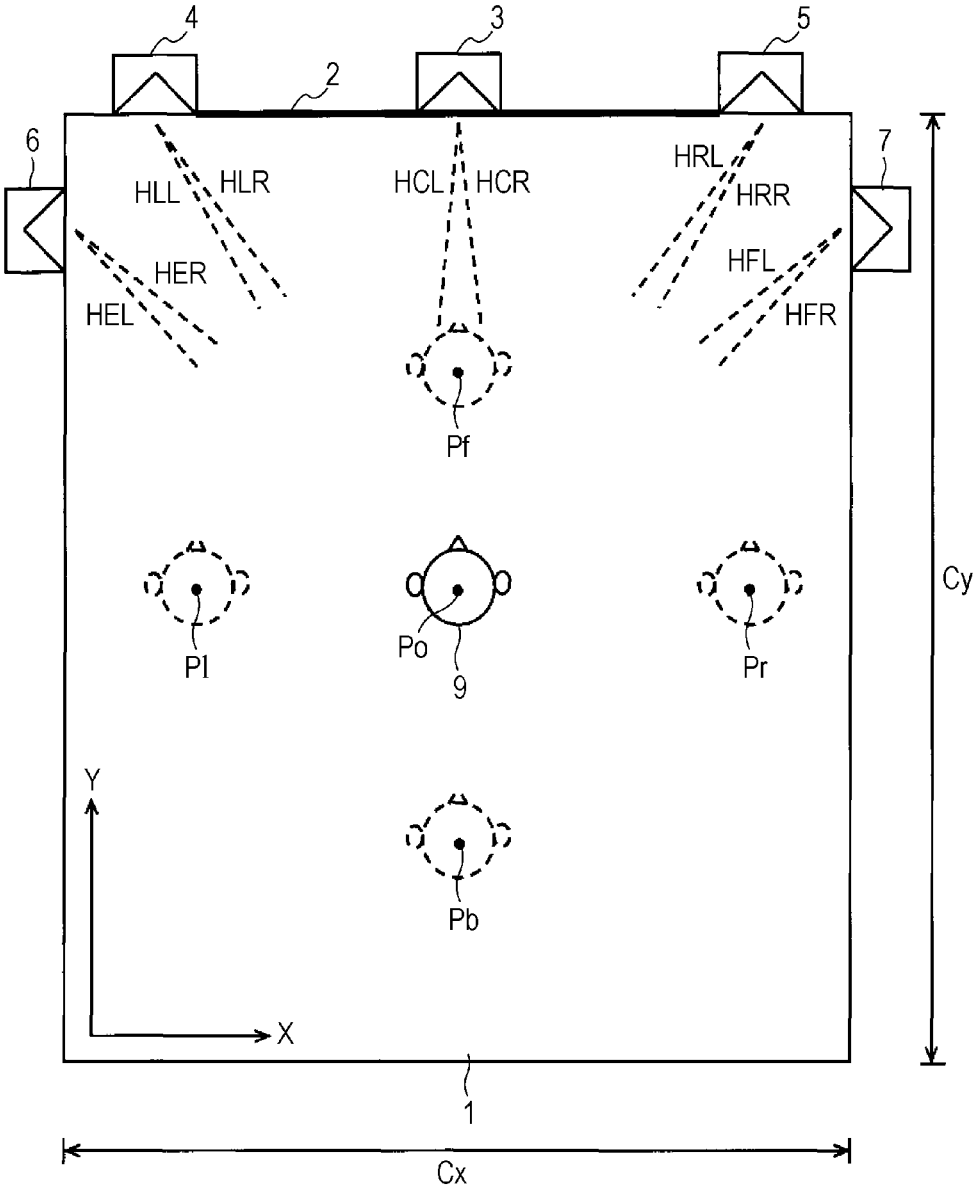
FIG. 3 is a schematic diagram showing an example of a virtual viewing space.

<1-1-3. Virtual Viewing Space: FIG. 3>

A virtual viewing space such as in a virtual theater is assumed for the information processing unit 10 to display an image on the display 11 and to output sound through the earphone unit 50. FIG. 3 shows an example of the virtual viewing space.

A virtual viewing space 1 in this example is a rectangular space on the reference plane (a plane parallel to the paper plane in FIG. 3), where an image display surface 2, a center speaker 3, and left and right speakers 4 and 5 are provided in the front of the listener, and speakers 6 and 7 are provided on left and right sides closer to the front.

The number of speakers and their arrangement just represent an example; any number of the speakers may be provided in any positions.

The image display surface 2 is a panel on which an image is displayed, as a screen by projection or as a display.

A position Po is a center position of the virtual viewing space 1, and a state of a listener's head 9 indicated by solid lines shows a state in which the listener's head 9 faces the image display surface 2 at the position Po.

A movement of the listener from the position Po to a position Pf is equivalent to a movement to a seat in the front in an actual theater, and a movement from the position Po to a position Pb is equivalent to a movement to a seat in the back in the actual theater.

A movement of the listener from the position Po to a position Pl is equivalent to a movement to a seat on the left side in the actual theater, and a movement from the position Po to a position Pr is equivalent to a movement to a seat on the right side in the actual theater.

The X axis runs in a lateral direction in the virtual viewing space 1, the Y axis runs in a longitudinal direction in the virtual viewing space 1, and the Z axis runs perpendicular to the reference plane (a plane parallel to the paper plane in FIG. 3).

Figure 4:
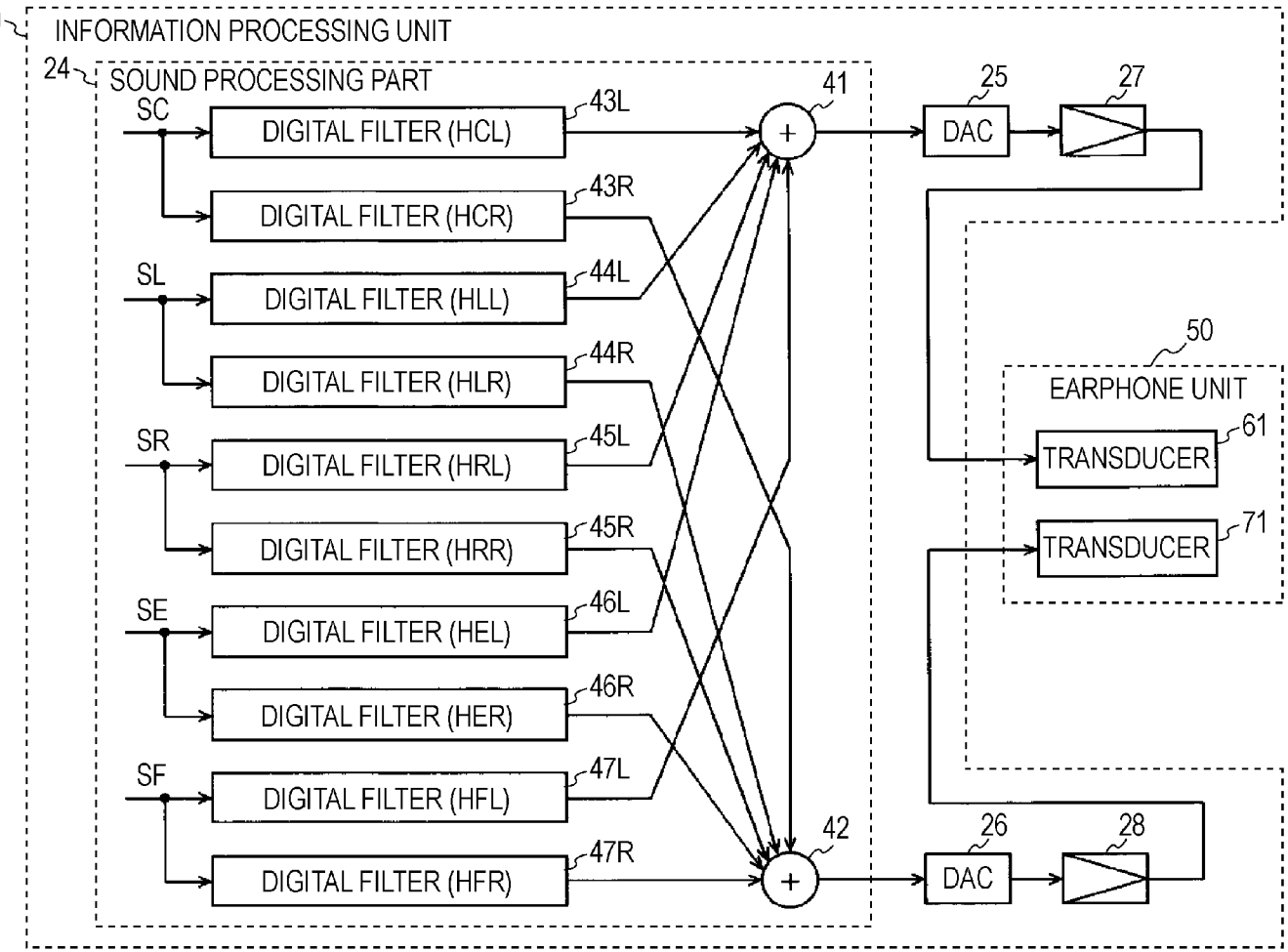
FIG. 4 is a block diagram of an example of a configuration for a sound image localization.

<1-1-4. Sound Image Localization: FIG. 4>

FIG. 4 shows an example of a configuration for a sound image localization performed by the sound processing part 24 in the information processing unit 10 when the virtual viewing space 1 is assumed as shown in FIG. 3.

Audio signals SC, SL, SR, SE, and SF are digital sound data in respective channels output from the virtual speakers 3, 4, 5, 6, and 7 provided in the virtual viewing space 1 shown in FIG. 3. If the data has been compressed, decompressed digital sound data is output.

The audio signal SC is supplied to digital filters 43L and 43R, the audio signal SL is supplied to digital filters 44L and 44R, and the audio signal SR is supplied to digital filters 45L and 45R.

The audio signal SE is supplied to digital filters 46L and 46R, and the audio signal SF is supplied to digital filters 47L and 47R.

The digital filter 43L convolves an impulse response generated by converting a transfer function HCL from the position of the speaker 3 to the left ear of the listener's head 9 into a time domain.

The digital filter 43R convolves an impulse response generated by converting a transfer function HCR from the position of the speaker 3 to the right ear of the listener's head 9 into the time domain.

The digital filter 44L convolves an impulse response generated by converting a transfer function HLL from the position of the speaker 4 to the left ear of the listener's head 9 into the time domain.

The digital filter 44R convolves an impulse response generated by converting a transfer function HLR from the position of the speaker 4 to the right ear of the listener's head 9 into the time domain.

The digital filter 45L convolves an impulse response generated by converting a transfer function HRL from the position of the speaker 5 to the left ear of the listener's head 9 into the time domain.

The digital filter 45R convolves an impulse response generated by converting a transfer function HRR from the position of the speaker 5 to the right ear of the listener's head 9 into the time domain.

The digital filter 46L convolves an impulse response generated by converting a transfer function HEL from the position of the speaker 6 to the left ear of the listener's head 9 into the time domain.

The digital filter 46R convolves an impulse response generated by converting a transfer function HER from the position of the speaker 6 to the right ear of the listener's head 9 into the time domain.

The digital filter 47L convolves an impulse response generated by converting a transfer function HFL from the position of the speaker 7 to the left ear of the listener's head 9 into the time domain.

The digital filter 47R convolves an impulse response generated by converting a transfer function HFR from the position of the speaker 7 to the right ear of the listener's head 9 into the time domain.

Audio signals output from the digital filters 43L, 44L, 45L, 46L, and 47L are added by an adder circuit 41. Audio signals output from the digital filters 43R, 44R, 45R, 46R, and 47R are added by an adder circuit 42.

The audio signals output from the adder circuit 41 are converted into analog audio signals by the DAC 25 shown in FIG. 2. The converted audio signals are amplified by the audio amplifier circuit 27 as left audio signals, and then supplied to the transducer 61.

The audio signals output from the adder circuit 42 are converted into analog audio signals by the DAC 26 shown in FIG. 2. The converted audio signals are amplified by the audio amplifier circuit 28 as right audio signals, and then supplied to the transducer 71.

(1-2. Information Processing Method: FIGS. 5 to 13)

According to the embodiment, the sound image localization is controlled so that, when the display 11 is moved or rotated, a positional relation between the display 11 after the movement or the rotation and the listener's head 9 is mapped as a positional relation between the image display surface 2 and the listener's head 9 in the virtual viewing space 1.

Figure 5:
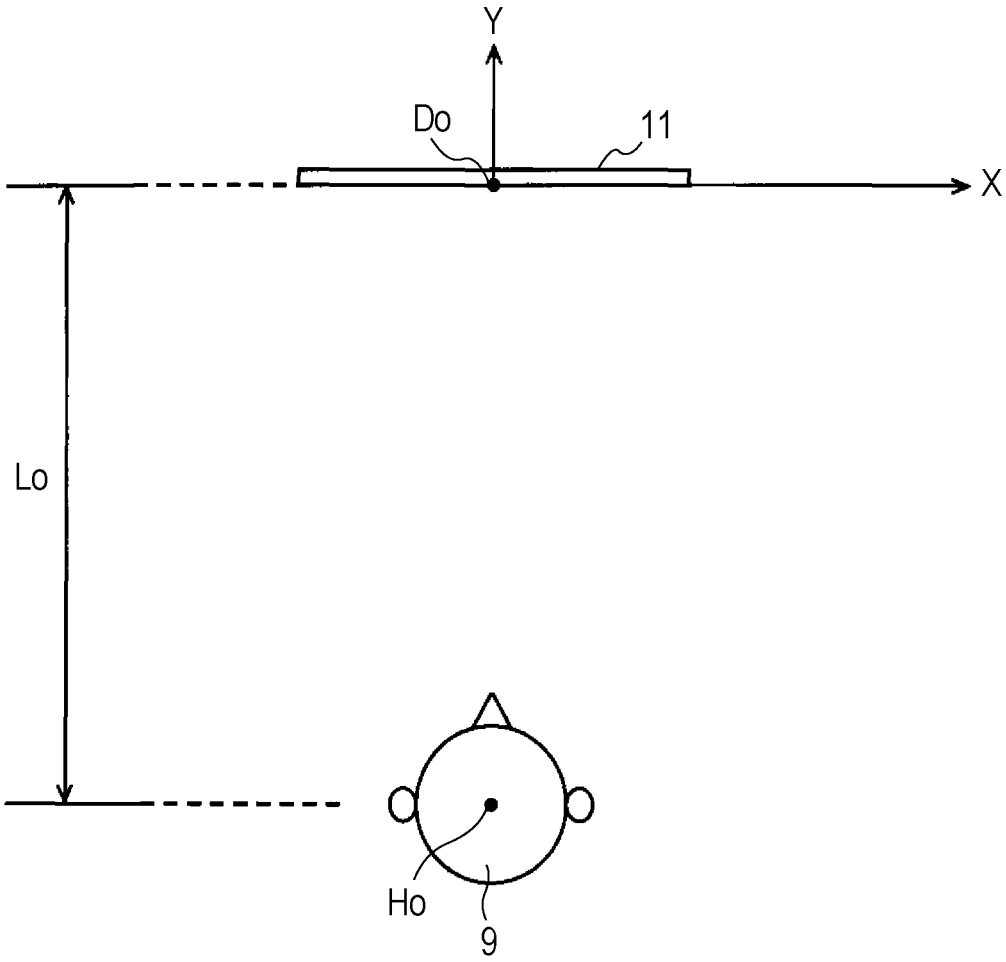
FIG. 5 is a schematic diagram showing an example of an initial state.

<1-2-1. Initial State: FIG. 5>

In order to control the sound image localization in this manner, it may be necessary to set an initial state.

FIG. 5 shows an example of the initial state set in an actual viewing space.

When the listener views an image and listens to music using the information processing system 100, the listener operates the operation part 12 to set the information processing unit 10 to the initial state in which the display 11 is located in a certain position and a certain direction from the listener.

FIG. 5 shows a case in which the listener sets the initial state with the information processing unit 10 in his or her hand facing the display 11 so that the display 11 is located in a position Do at a certain distance Lo from a position Ho of the listener's head 9 in the front direction.

With the information processing unit 10 in this case, a plane extending from the panel of the display 11 in the lateral direction and crossing the panel of the display 11 at a predetermined angle is a reference plane, an X axis runs in a lateral direction of the panel on the reference plane, a Y axis runs in a direction perpendicular to the X-axis, and a Z axis runs in a direction perpendicular to the reference plane.

The acceleration sensor 31 shown in FIG. 2 detects accelerations of movements in directions of the X axis and the Y axis, and the gyro sensor 32 detects an angular velocity of a rotation in the direction of the Z axis.

Although the initial distance Lo between the display 11 and the listener's head 9 is arbitrary, the distance when a person views the display panel in his or her hand is generally about 30 cm.

The initial state is the state in which the listener views and listens to an image and a sound such as a movie in a predetermined position, such as the center position Po, in the virtual viewing space 1, as shown in FIG. 3.

Therefore, when the positional relation between the display 11 and the listener's head 9 is in the initial state set in advance, the sound image localization is controlled so that the listener can listen to the sound in the position Po and the direction from the virtual speakers 3 to 7 as shown in FIG. 3.

Figure 7:
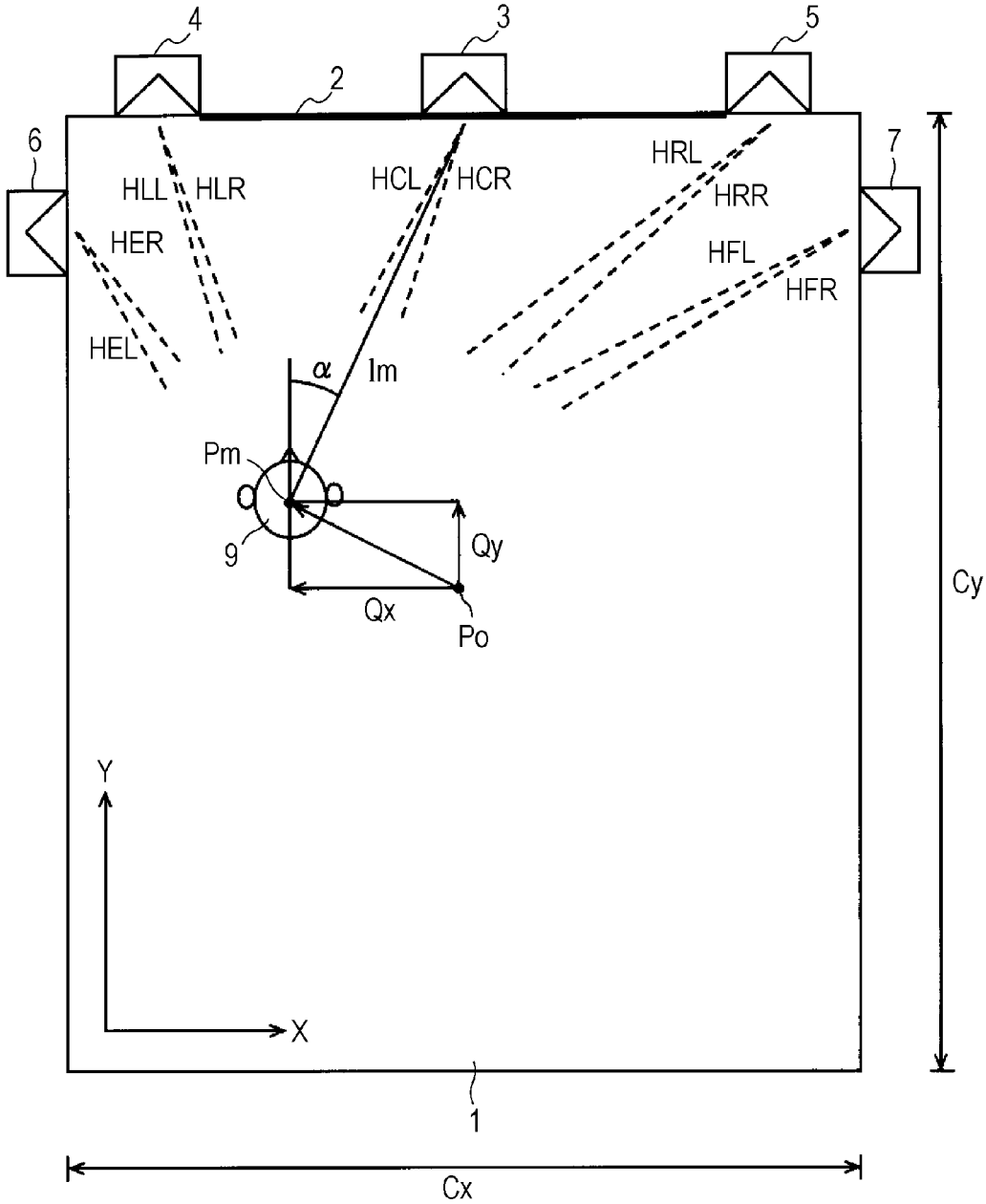
FIG. 7 is a schematic diagram showing a position and an orientation of a listener in the virtual viewing space in FIG. 6.

<1-2-2. When Display is Moved: FIGS. 6 and 7>

In a first method in the embodiment, the listener moves the display 11 in the direction of the X axis or the Y axis.

FIG. 6 shows a case in which the listener moves the display 11 from the initial state described above in a positive direction on the X axis by a distance Dx and in a negative direction on the Y axis by a distance Dy, as indicated by reference characters 11*m*.

The positive direction on the X axis is the right direction on the panel, the negative direction on the X axis is the left direction on the panel, the positive direction on the Y axis is a direction away from the listener's head 9, and the negative direction on the Y axis is a direction closer to the listener's head 9.

The position Do is an initial position of the display 11, and a position Dm is a position of the display 11 after the movement.

A distance Lm is a distance between the display 11*m* after the movement of the display 11 and the listener's head 9. If the initial distance Lo is set to, for example, 30 cm, the distance Lm can be computed using an equation (1) shown in FIG. 6.

The operation controller 21 in the information processing unit 10 computes the moving distance Dx on the X axis and the moving distance Dy on the Y axis of the display 11 by integrating each of accelerations in the directions on the X axis and the Y axis output from the acceleration sensor 31 two times.

Furthermore, the operation controller 21 in the information processing unit 10 selects and determines processing parameters of the sound image localization so that the positional relation between the moved display 11*m* and the listener's head 9 is mapped as the positional relation between the image display surface 2 and the listener's head 9 in the virtual viewing space 1.

One method for map conversion includes computing $Qx=K\cdot Dx$, $Qy=K\cdot Dy$, where K is a transformation ratio in the direction on the X axis and also a transformation ratio in the direction on the Y axis, Qx is the moving distance on the X axis, and Qy is the moving distance on the Y axis.

Because the range of the virtual viewing space 1 and the distance between the image display surface 2 and the center position Po are sufficiently large compared with a range that the listener hand can reach at the maximum in an actual viewing space and the distance Lo in the actual viewing space, the transformation ratio K should be larger than one.

The fact that the display 11 moves in the positive direction on the X axis by the distance Dx and in the negative direction on the Y axis by the distance Dy in the actual viewing space is equivalent to the fact that the listener's head 9 moves in the negative direction on the X axis by the distance Qx and in the positive direction on the Y axis by the distance Qy in the virtual viewing space 1.

Therefore, a position moving from the center position Po in the negative direction on the X axis by the distance Qx and in the positive direction on the Y axis by the distance Qy is computed as a position Pm of the listener's head 9 in the virtual viewing space 1, as shown in FIG. 7.

The position Pm is located in a direction rotating clockwise in the negative direction on the Y axis by an angle $\alpha$ expressed in an equation (2) shown in FIG. 6, as seen from the image display surface 2 in the virtual viewing space 1.

Another method includes computing the position Pm of the listener's head 9 in the virtual viewing space 1 using the distance Lm and the angle $\alpha$.

That is, in this case, a point away from the center of the image display surface 2 in the lateral direction by a distance lm, which is a product of the distance Lm and the transformation ratio K, in the direction rotating clockwise in the negative direction on the Y axis by the angle $\alpha$ as seen from the image display surface 2 is computed as the position Pm of the listener's head 9 in the virtual viewing space 1.

The transformation ratio K can be determined in consideration of a width Cx in the direction of the X axis (lateral direction), or a depth Cy in the direction of the Y axis (longitudinal direction) of the virtual viewing space 1.

For example, it is assumed that a length of a human arm is 50 cm, and that the distance Lm between the display 11 and the listener's head 9 in the actual viewing space is 50 cm at the maximum.

Assuming that the maximum value of the distance Lm is Lmmax, when the depth Cy is taken into consideration;

$$lm:Lm=Cy:Lm\text{max} \tag{5}$$

i.e., $$lm=Cy\times Lm/Lm\text{max} \tag{6}$$

Otherwise, when the width Cx is taken into consideration;

$$lm:Lm=Cx/2:Lm\text{max} \tag{7}$$

i.e., $$lm=Cx\times Lm/2\times Lm\text{max} \tag{8}$$

Figure 8:
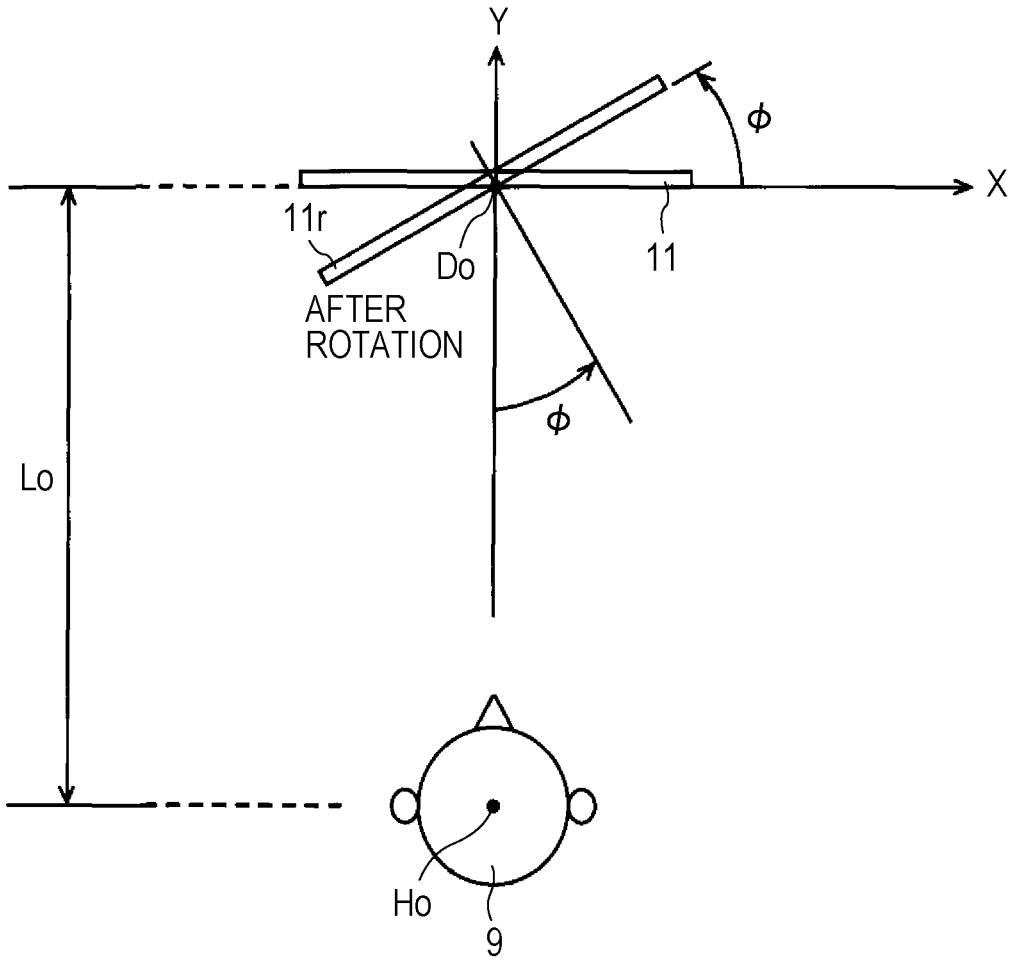
FIG. 8 is a schematic diagram showing an example of rotating the display according to the embodiment.
Figure 9:
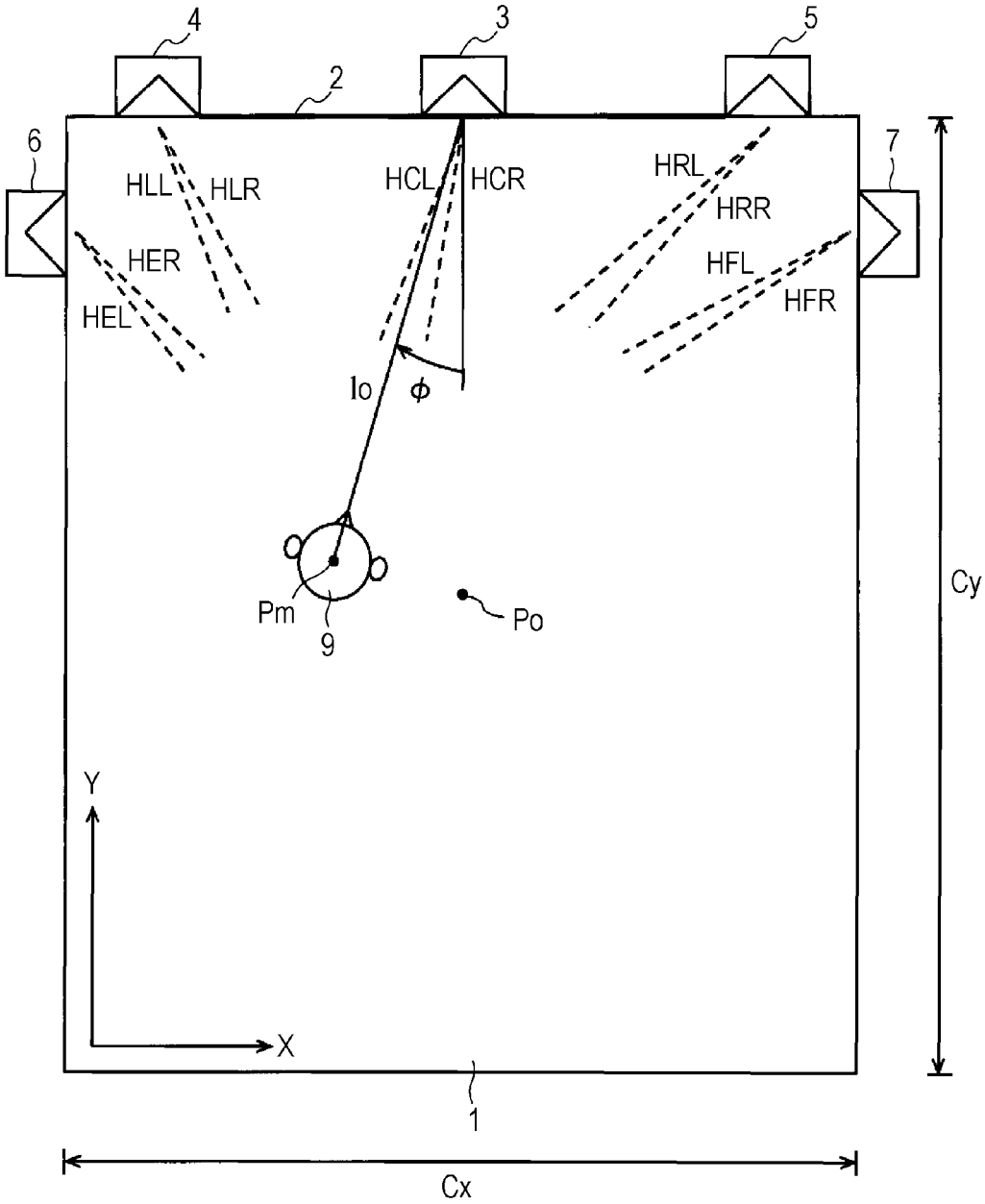
FIG. 9 is a schematic diagram showing a position and an orientation of the listener in the virtual viewing space in FIG. 8.

<1-2-3. When Display is Rotated: FIGS. 8 and 9>

A second method of the embodiment is employed when the listener rotates the display 11 around the Z axis.

FIG. 8 shows a case in which the listener rotates the display 11 from the initial state shown in FIG. 5 around the Z axis with its rotation center at the position Do in a counterclockwise direction seen from the above (closer side on the plane of paper) by an angle $\phi$, as indicated by reference characters 11*r*.

The operation controller 21 in the information processing unit 10 computes the rotation angle $\phi$ by integrating the angular velocity of the rotation around the Z axis output from the gyro sensor 32.

Furthermore, the operation controller 21 in the information processing unit 10 selects and determines processing parameters of the sound image localization so that the positional relation between the rotated display 11*r* and the listener's head 9 is mapped as the positional relation between the image display surface 2 and the listener's head 9 in the virtual viewing space 1.

Specifically, the fact that the display 11 rotates in the counterclockwise direction by the angle $\phi$ in the actual viewing space is equivalent to the fact that the listener's head 9 rotates in the clockwise direction by the angle $\phi$ in the virtual viewing space 1.

Therefore, in this case, as shown in FIG. 9, a point away from the center of the image display surface 2 in the lateral direction by a distance lo, which is a product of the distance Lo and the transformation ratio K, in the direction rotating clockwise in the negative direction on the Y axis by the angle $\phi$ as seen from the image display surface 2 is computed as the position Pm of the listener's head 9 in the virtual viewing space 1.

An orientation of the listener's head 9 is in a direction facing the center of the image display surface 2 in the lateral direction.

Figure 11:
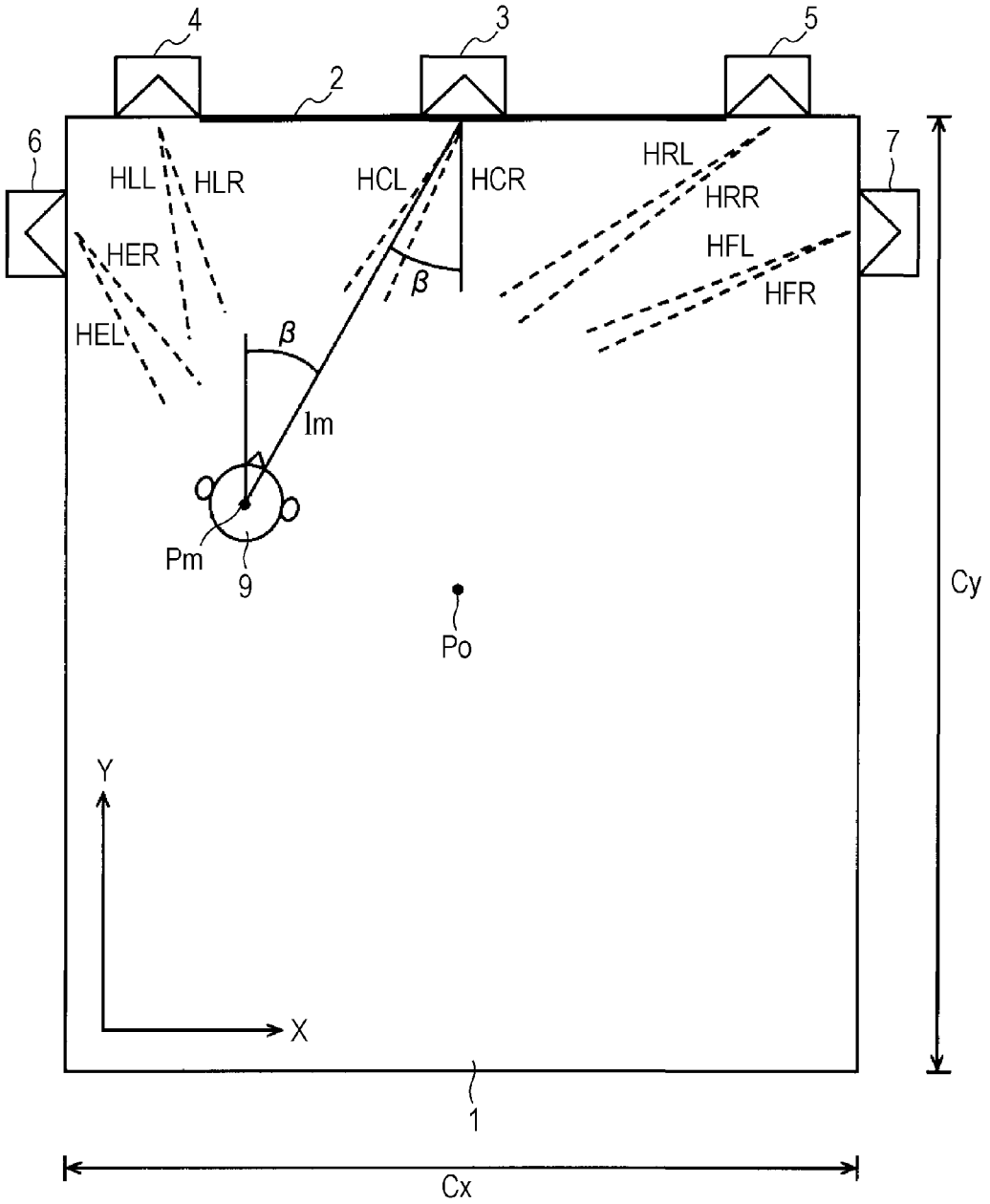
FIG. 11 is a schematic diagram showing a position and an orientation of the listener in the virtual viewing space in FIG. 10.

<1-2-4. When Display is Moved and Rotated: FIGS. 10 and 11>

A third method of the embodiment is employed when the listener moves and rotates the display 11.

An example is shown in FIG. 10, in which the listener moves the display 11 from the initial state shown in FIG. 5 in the positive direction on the X axis by the distance Dx and in the negative direction on the Y axis by the distance Dy, and rotates the display 11 around the Z axis in the counterclockwise direction by the angle $\phi$, as indicated by reference characters 11*mr*.

In other words, in this case, the display 11 is moved as shown in FIG. 6 and rotated as shown in FIG. 8.

In this case, as shown in FIG. 11, a point away from the center of the image display surface 2 in the lateral direction by the distance lm (=K×Lm) in the direction rotating clockwise in the negative direction on the Y axis by an angle $\beta$ (=$\phi+\alpha$) as seen from the image display surface 2 is computed as the position Pm of the listener's head 9 in the virtual viewing space 1.

Figure 12:
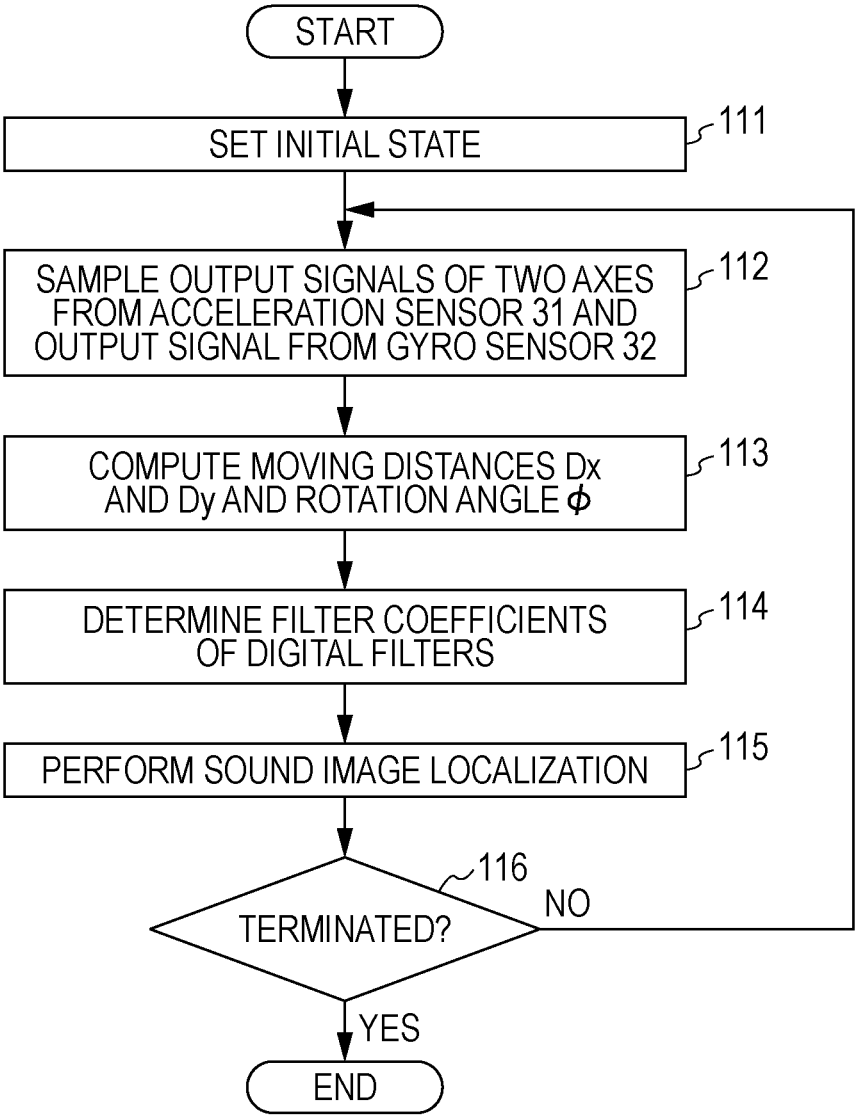
FIG. 12 is a flowchart of an example of a series of a process performed by an operation controller in the information processing unit according to the embodiment.

<1-2-5. Processing of Operation Control: FIGS. 12 and 13>

FIG. 12 shows an example of a series of a process performed by the operation controller 21 in the information processing unit 10 according to the embodiment.

In this example, at Step 111, the initial state is set based on an operation by the listener as described above.

Next, at Step 112, output signals of two axes from the acceleration sensor 31 and an output signal from the gyro sensor 32 are sampled and converted into digital data, thereby obtaining data indicative of the accelerations of the movement of the display 11 in the directions of the X axis and the Y axis and data indicative of the angular velocity of the rotation of the display 11 around the Z axis.

At Step 113, the moving distance Dx in the direction on the X axis, the moving distance Dy in the direction on the Y axis, and the rotation angle $\phi$ around the Z axis by which the display 11 moves are computed using equations (11), (12), and (13) shown in FIG. 13.

At Step 114, based on the result of the computation, filter coefficients of the digital filters 43L, 43R, 44L, 44R, 45L, 45R, 46L, 46R, 47L, and 47R shown in FIG. 4 are determined.

At Step 115, the sound processing part 24 performs the sound image localization based on the determined filter coefficients.

At Step 116, it is determined whether the series of the process should be terminated, and the process returns from Step 116 to Step 112 to repeat the process in Steps 112 to 115 except when the series of the process is terminated by, for example, a termination operation by the listener.

2. Another Embodiment

FIGS. 14 to 19

Another embodiment of the present invention shows a case in which, not only the display moves and/or rotates as in the embodiment described above, but also the listener moves and/or rotates.

Figure 14:
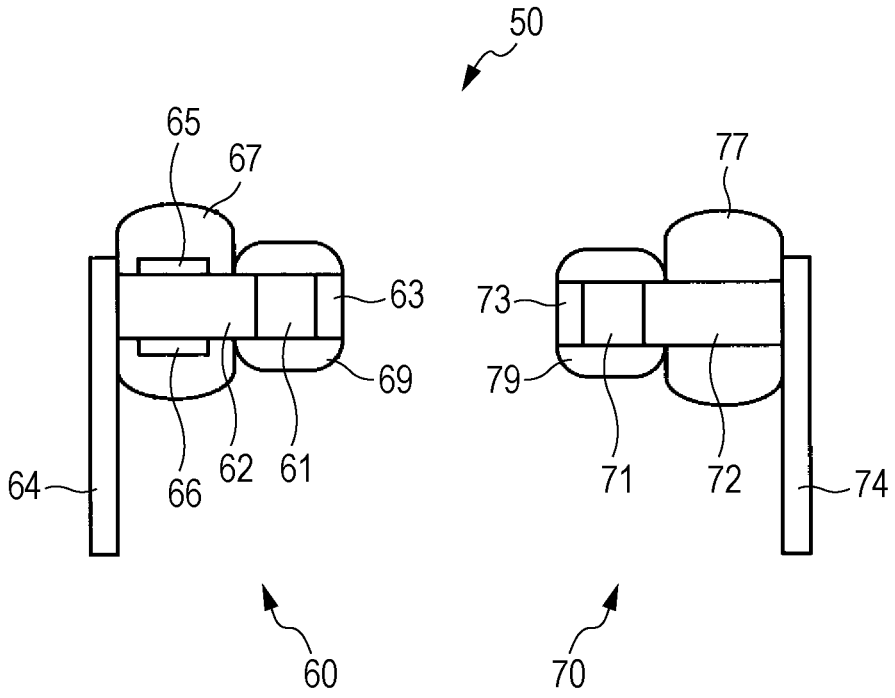
FIG. 14 is a schematic diagram showing an example of an earphone unit according to another embodiment of the present invention.
Figure 15:
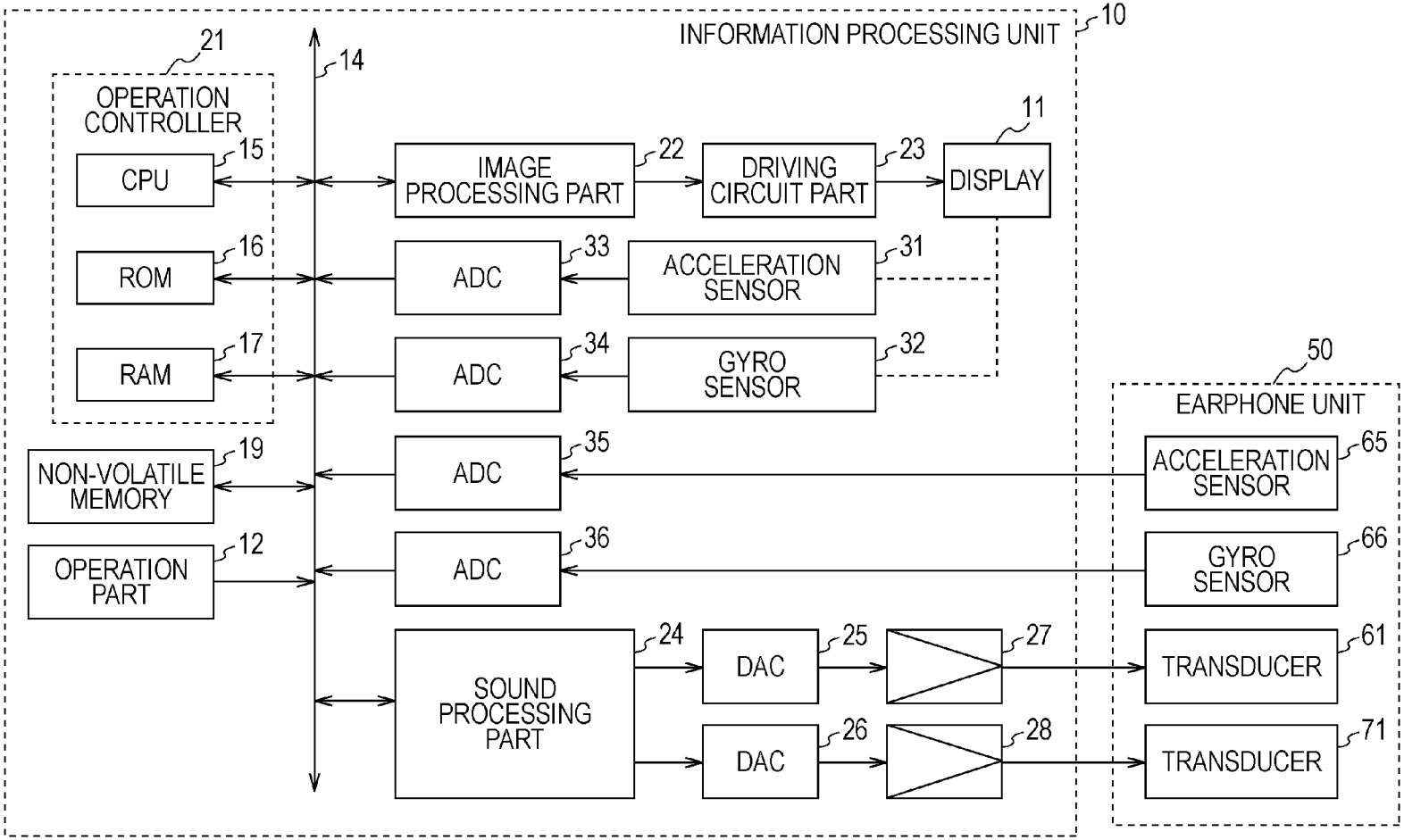
FIG. 15 is a block diagram of the external configuration of an information processing unit according to the other embodiment.

(2-1. System Configuration: FIGS. 14 and 15)

According to the other embodiment, the information processing system 100 includes the information processing unit 10 and the earphone unit 50, as shown in, for example, FIG. 1.

The other embodiment is similar to the embodiment also in that the information processing unit 10 includes the display 11 and the operation part 12 as seen from the outside.

Furthermore, according to the other embodiment, the earphone unit 50 is configured with a sensor capable of detecting the movement or the rotation of the listener's head 9. FIG. 14 shows an example.

The left earphone part 60 is attached with the transducer 61 and a grill 63 on one end of an inner frame 62, and a cord bushing 64 on the other end.

An acceleration sensor 65, a gyro sensor 66, and a housing 67 are attached on a portion, of the left earphone part 60, which is outside an ear. An ear piece 69 is attached on a portion, of the left earphone part 60, which is inside the ear.

The right earphone part 70 is, as with the left earphone part 60, attached with the transducer 71 and a grill 73 on one end of an inner frame 72, and a cord bushing 74 on the other end.

A housing 77 is attached on a portion, of the right earphone part 70, which is outside an ear. An ear piece 79 is attached on a portion, of the right earphone part 70, which is inside the ear.

The acceleration sensor 65 detects an acceleration of the movement in directions of two mutually orthogonal axes (X axis and Y axis) on a reference plane to be described later, and the gyro sensor 66 detects an angular velocity of the rotation around an axis perpendicular to the reference plane (Z axis).

In the information processing unit 10, as shown in FIG. 15, in addition to the configuration of the embodiment shown in FIG. 2, ADCs 35 and 36, which respectively convert output signals from the acceleration sensor 65 and the gyro sensor 66 of the earphone unit 50 into digital data, are connected to the bus 14.

According to the other embodiment, for example, the virtual viewing space 1 as shown in FIG. 3 is assumed, and the sound processing part 24 in the information processing unit 10 performs the sound image localization as shown in FIG. 4.

(2-2. Information Processing Method: FIGS. 16 to 19)

According to the other embodiment, the information processing unit 10 sets the initial state based on the operation by the listener. The initial state is, for example, such a state as shown in FIG. 5.

According to the other embodiment, there are following cases of combinations of the movement and/or rotation of the display 11 and the listener:

(a) the listener moves the display 11 and moves his or her head;

(b) the listener moves the display 11 and rotates his or her head;

(c) the listener rotates the display 11 and moves his or her head;

(d) the listener rotates the display 11 and rotates his or her head;

(e) the listener moves and rotates the display 11 and also moves and rotates his or her head.

In any cases, the sound image localization is controlled so that the positional relation between the display 11 and the listener's head 9 in the actual viewing space is mapped as the positional relation between the image display surface 2 and the listener's head 9 in the virtual viewing space 1.

FIG. 16 shows the case of (e), in which the listener moves and rotates the display 11 and also moves and rotates his or her head.

Specifically, in this case, the display 11 moves and rotates as shown in FIG. 10, and the listener's head 9 moves in the positive direction on the X axis by a distance Hx and in the negative direction on the Y axis by a distance Hy and rotates around the Z axis in the clockwise direction by an angle θ, which is an opposite direction of the rotation of the display 11.

The position Do, the distance Lo, the position Dm, the distance Dx, the distance Dy, and the rotation angle ϕ are respectively identical to those shown in FIGS. 5, 6, 8, and 10.

In this case, the position Ho is the initial position of the listener's head 9, and a position Hm is the position of the listener's head 9 after the movement.

The moving distance Dx of the display 11 on the X axis and the moving distance Dy on the Y axis are computed by, as described in the embodiment, integrating each of the accelerations in the directions on the X axis and the Y axis output from the acceleration sensor 31 two times.

The moving distance Hx of the listener's head 9 on the X axis and the moving distance Hy on the Y axis are computed by integrating each of the accelerations in the directions on the X axis and the Y axis output from the acceleration sensor 65 two times.

The rotation angle ϕ of the display 11 is computed by, as described in the embodiment, integrating the angular velocity output from the gyro sensor 32.

The rotation angle θ of the listener's head 9 is computed by integrating the angular velocity output from the gyro sensor 66.

If the initial distance Lo is set to, for example, 30 cm, the distance Lm between the display 11*mr* and the listener's head 9 after the movement and the rotation of the display 11 and the listener's head 9 can be computed using an equation (3) shown in FIG. 16. The angle α shown in FIG. 16 is expressed by an equation (4) shown in FIG. 16.

The operation controller 21 in the information processing unit 10 selects and determines processing parameters of the sound image localization so that the positional relation between the display 11*mr* and the listener's head 9 after the movement and the rotation as described above is mapped as the positional relation between the image display surface 2 and the listener's head 9 in the virtual viewing space 1.

Specifically, the fact that the display 11 rotates in the counterclockwise direction by the angle ϕ in the actual viewing space is equivalent to the fact that the listener's head 9 rotates in the clockwise direction by the angle ϕ in the virtual viewing space 1.

The fact that the listener's head 9 rotates in the clockwise direction by the angle θ in the actual viewing space is equivalent to the fact that the listener's head 9 also rotates in the clockwise direction by the angle θ in the virtual viewing space 1.

Figure 17:
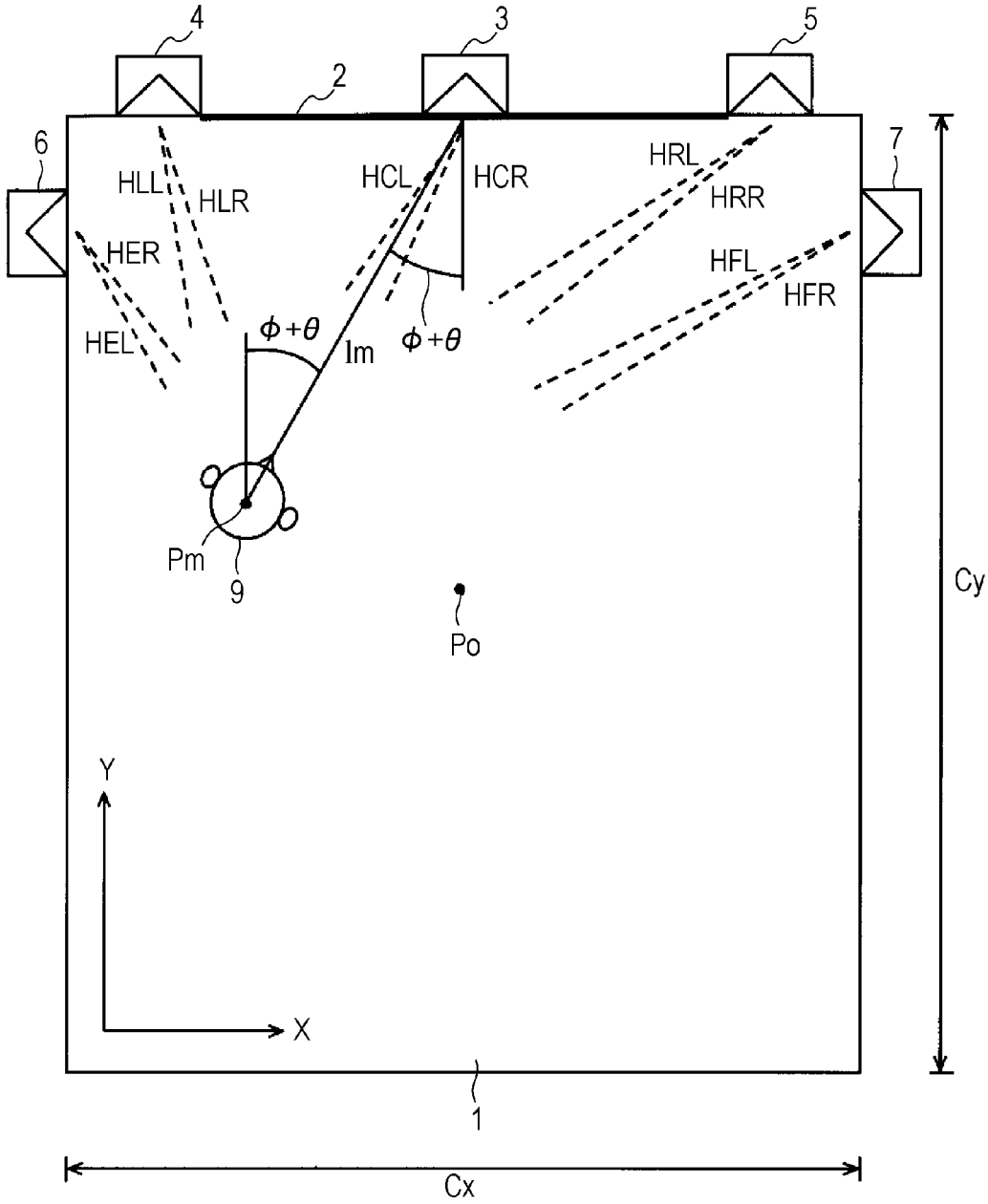
FIG. 17 is a schematic diagram showing a position and an orientation of the listener in the virtual viewing space in FIG. 16.

Therefore, in this case, as shown in FIG. 17, a point away from the center of the image display surface 2 in the lateral direction by the distance lm (=K×Lm) in the direction rotating clockwise in the negative direction on the Y axis by the angle (ϕ+θ) as seen from the image display surface 2 is computed as the position Pm of the listener's head 9 in the virtual viewing space 1.

An orientation of the listener's head 9 is in a direction facing the center of the image display surface 2 in the lateral direction.

Figure 18:
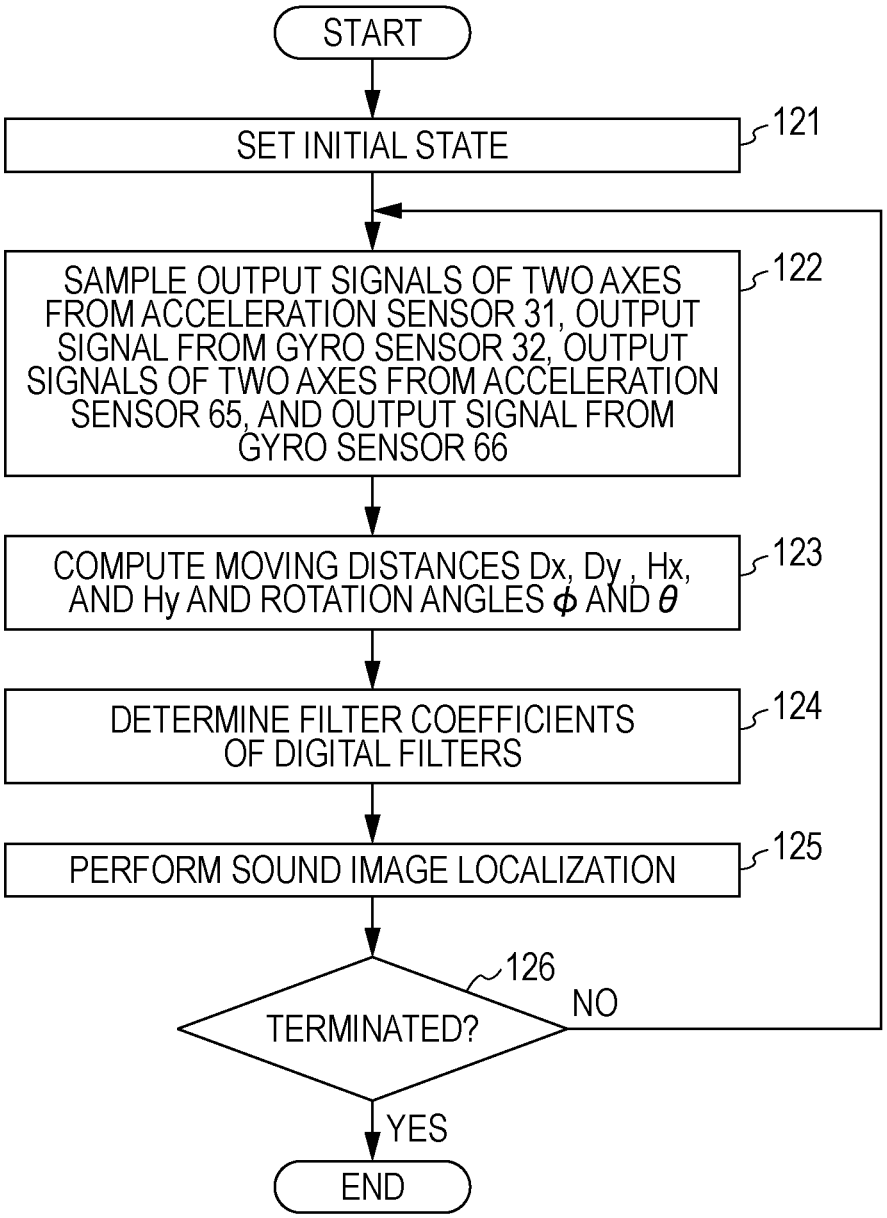
FIG. 18 is a flowchart of an example of a series of a process performed by an operation controller in the information processing unit according to the other embodiment.

FIG. 18 shows an example of a series of a process performed by the operation controller 21 in the information processing unit 10 according to the other embodiment.

In this example, at Step 121, the initial state is set based on an operation by the listener as described above.

Next, at Step 122, output signals of two axes from the acceleration sensor 31, an output signal from the gyro sensor 32, output signals of two axes from the acceleration sensor 65, and an output signal from the gyro sensor 66 are sampled and converted into digital data, thereby obtaining data indicative of the accelerations of the movement of the display 11 in the directions of the X axis and the Y axis, data indicative of the angular velocity of the rotation of the display 11 around the Z axis, data indicative of the accelerations of the movement of the listener's head 9 in the directions of the X axis and the Y axis, and data indicative of the angular velocity of the rotation of the listener's head 9 around the Z axis.

At Step 123, the moving distance Dx in the direction on the X axis, the moving distance Dy in the direction on the Y axis, and the rotation angle ϕ around the Z axis by which the display 11 moves are computed using equations (11), (12), and (13) shown in FIG. 19, and the moving distance Hx in the direction on the X axis, the moving distance Hy in the direction on the Y axis, and the rotation angle θ around the Z axis by which the listener's head 9 moves are computed using equations (21), (22), and (23) shown in FIG. 19.

At Step 124, based on the result of the computation, filter coefficients of the digital filters 43L, 43R, 44L, 44R, 45L, 45R, 46L, 46R, 47L, and 47R shown in FIG. 4 are determined.

At Step 125, the sound processing part 24 performs the sound image localization based on the determined filter coefficients.

At Step 126, it is determined whether the series of the process should be terminated, and the process returns from Step 126 to Step 122 to repeat the process in Steps 122 to 125 except when the series of the process is terminated by, for example, a termination operation by the listener.

3. Other Embodiment

FIG. 20

Figure 20:
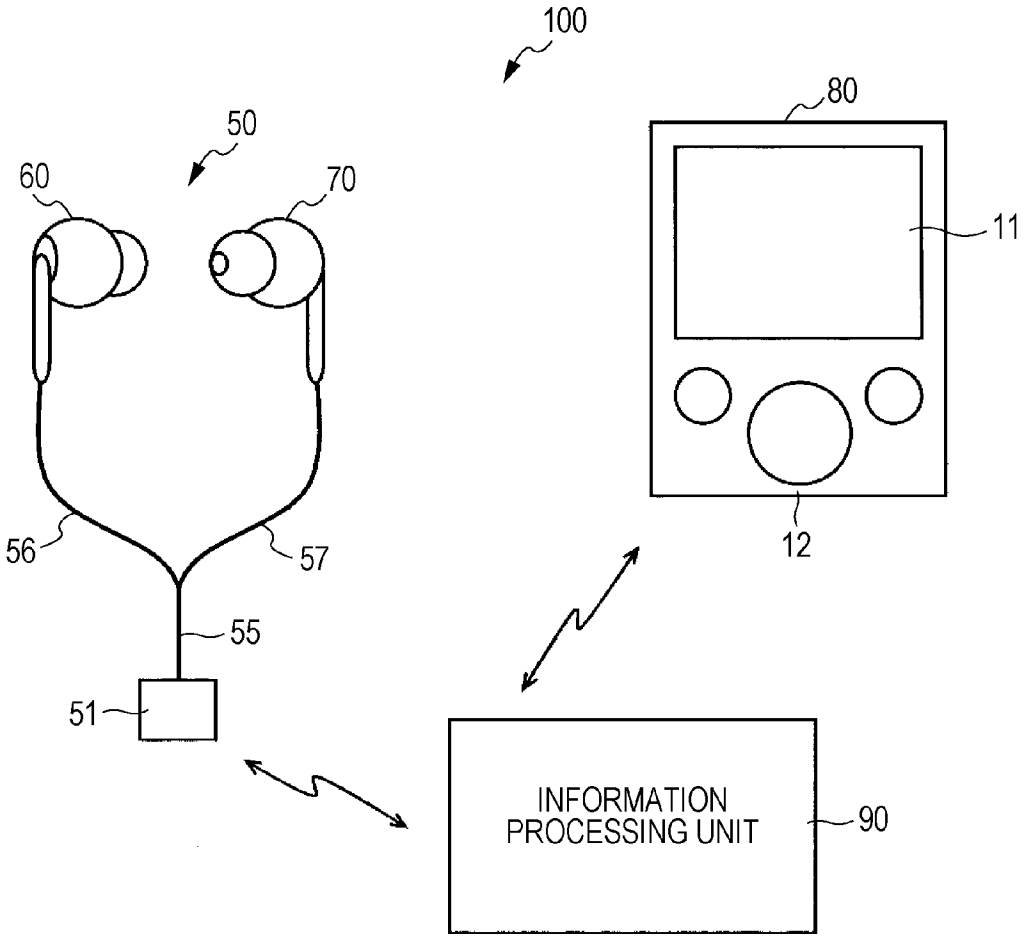
FIG. 20 is a schematic diagram of an information processing system according to an embodiment of the present invention.

As shown in FIG. 20, the information processing system 100 may be configured with a display unit 80, an information processing unit 90, and the earphone unit 50. In this case, it is desirable to connect the display unit 80 to the information processing unit 90 and the information processing unit 90 to the earphone unit 50 by wireless communication such as Bluetooth®.

The information processing unit 90 stores image data and music data in a hard disk or the like, and performs an image processing and a sound processing including the sound image localization described above, as a home server.

The display unit 80 includes the display 11, the operation part 12, an acceleration sensor for detecting a movement of the display 11, a gyro sensor for detecting a rotation of the display 11, and the like, and transmits output signals from the sensors to the information processing unit 90.

The earphone unit 50 includes a circuit part 51 provided with a battery, a wireless communication module, and a volume control, and, to deal with the movement and/or the rotation of the listener's head 9 as in the other embodiment, an acceleration sensor and a gyro sensor are provided in the left earphone part 60 or the right earphone part 70.

The information processing unit 10 may be connected to the earphone unit 50 by the wireless communication even when the information processing system 100 includes the information processing unit 10 and the earphone unit 50, as shown in FIG. 1.

The transducer unit is not limited to the earphone unit, but may be a headphone unit.

The present application contains subject matter related to that disclosed in Japanese Priority Patent Application JP 2008-319316 filed in the Japan Patent Office on Dec. 16, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An information processing system comprising:

a display;

a display sensor configured to detect a movement or a rotation of the display;

a transducer unit configured as an earphone unit or a headphone unit;

a sound processing part configured to process an audio signal so as to localize a sound image produced by the transducer unit in a position outside a head of a listener wearing the transducer unit; and an operation controller configured to:

compute a positional relation between the display and the head of the listener in an actual viewing space by computing an output from the display sensor configured to detect the movement or the rotation of the display to obtain at least one of (a) a moving direction and a moving distance of the display with respect to the head of the listener, and (b) a rotation direction and a rotation angle of the display with respect to the head of the listener, and control the localization of the sound image by the sound processing part in accordance with a result of the computation of the positional relation between the display and the head of the listener in the actual viewing space so that the computed positional relation between the display and the head of the listener is mapped as a positional relation between an image display surface and the head of the listener in a virtual viewing space.

2. The information processing system according to claim 1, further comprising a transducer sensor attached to the transducer unit and configured to detect a movement or a rotation of the head of the listener;

wherein the operation controller is configured to compute the output from the display sensor and an output from the transducer sensor to obtain the moving direction and the moving distance, or the rotation direction and the rotation angle of the display, and the moving direction and the moving distance, or the rotation direction and the rotation angle of the head of the listener, and to control the sound processing performed by the sound processing part in accordance with a result of computation so that the positional relation between the display and the head of the listener is mapped as the positional relation between the image display surface and the head of the listener in the virtual viewing space.

3. The information processing system according to claim 1, wherein the information processing system comprises an information processing unit having the display, the display sensor, the sound processing part, the operation controller, and the transducer unit.

4. The information processing system according to claim 1, wherein the information processing system comprises:

a display unit having the display and the display sensor, an information processing unit having the sound processing part and the operation controller, and the transducer unit.

5. An information processing method performed by an information processing system including a display, a display sensor configured to detect a movement or a rotation of the display, a transducer unit configured as an earphone unit or a headphone unit, and a sound processing part configured to process an audio signal so as to localize a sound image produced by the transducer unit in a position outside a head of a listener wearing the transducer unit, the method comprising:

computing a positional relation between the display and the head of the listener in an actual viewing space by computing an output from the display sensor configured to detect the movement or the rotation of the display to obtain at least one of (a) a moving direction and a moving distance of the display with respect to the head of the listener, and (b) a rotation direction and a rotation angle of the display with respect to the head of the listener; and controlling the localization of the sound image by the sound processing part in accordance with a result of the computation of the positional relation between the display and the head of the listener in the actual viewing space so that the computed positional relation between the display and the head of the listener is mapped as the positional relation between an image display surface and the head of the listener in a virtual viewing space.

6. The information processing method according to claim 5, the information processing system further including a transducer sensor attached to the transducer unit and configured to detect a movement or a rotation of the head of the listener, the method further comprising computing an output from the transducer sensor to obtain the moving direction and the moving distance, or the rotation direction and the rotation angle of the head of the listener;

wherein the controlling comprises controlling the sound processing performed by the sound processing part in accordance with results of the computing an output from the display sensor and the computing an output from the transducer sensor so that the positional relation between the display and the head of the listener is mapped as the positional relation between the image display surface and the head of the listener in the virtual viewing space.

7. An apparatus comprising:

a display;

a display sensor configured to detect a movement or a rotation of the display;

a sound processing part configured to process an audio signal so as to localize a sound image in a position outside a head of a listener; and an operation controller configured to:

compute a positional relation between the display and the head of the listener in an actual viewing space by computing an output from the display sensor configured to detect the movement or the rotation of the display to obtain at least one of (a) a moving direction and a moving distance of the display with respect to the head of the listener, and (b) a rotation direction and a rotation angle of the display with respect to the head of the listener; and control the localization of the sound image by the sound processing part in accordance with a result of the computation of the positional relation between the display and the head of the listener in the actual viewing space so that the computed positional relation between the display and the head of the listener is mapped as a positional relation between an image display surface and the head of the listener in a virtual viewing space.

8. The apparatus according to claim 7, wherein the operation controller is configured to:

receive information on a movement or a rotation of the head of the listener;

compute, based on the output from the display sensor and the information on the movement or the rotation of the head of the listener, the moving direction and the moving distance, or the rotation direction and the rotation angle of the display, and the moving direction and the moving distance, or the rotation direction and the rotation angle of the head of the listener; and control the sound processing performed by the sound processing part in accordance with a result of the computation so that the positional relation between the display and the head of the listener is mapped as the positional relation between the image display surface and the head of the listener in the virtual viewing space.

9. The apparatus according to claim 8, wherein the operation controller is configured to receive the information on the movement or the rotation of the head of the listener from at least one transducer unit.

10. The apparatus according to claim 9, wherein the at least one transducer unit comprises an earphone unit or a headphone unit.

11. The apparatus according to claim 7, wherein the apparatus comprises an information processing unit comprising the display, the display sensor, the sound processing part, and the operation controller.

12. The apparatus according to claim 7, wherein the apparatus comprises:

a display unit comprising the display and the display sensor; and an information processing unit comprising the sound processing part and the operation controller.

13. At least one computer-readable device storing computer-executable instructions that, when executed by at least one processor, perform an information processing method in an information processing system including a display, a display sensor configured to detect a movement or a rotation of the display, a transducer unit configured as an earphone unit or a headphone unit, and a sound processing part configured to process an audio signal so as to localize a sound image produced by the transducer unit in a position outside a head of a listener wearing the transducer unit, the method comprising:

computing a positional relation between the display and the head of the listener in an actual viewing space by computing an output from the display sensor configured to detect the movement or the rotation of the display to obtain at least one of (a) a moving direction and a moving distance of the display with respect to the head of the listener, and (b) a rotation direction and a rotation angle of the display with respect to the head of the listener; and controlling the localization of the sound image by the sound processing part in accordance with a result of the computation of the positional relation between the display and the head of the listener in the actual viewing space so that the computed positional relation between the display and the head of the listener is mapped as the positional relation between an image display surface and the head of the listener in a virtual viewing space.

14. The at least one computer-readable device according to claim 13, wherein:

the information processing system further includes a transducer sensor attached to the transducer unit and configured to detect a movement or a rotation of the head of the listener;

the method further comprises computing an output from the transducer sensor to obtain the moving direction and the moving distance, or the rotation direction and the rotation angle of the head of the listener; and the controlling comprises controlling the sound processing performed by the sound processing part in accordance with results of the computing an output from the display sensor and the computing an output from the transducer sensor so that the positional relation between the display and the head of the listener is mapped as the positional relation between the image display surface and the head of the listener in the virtual viewing space.

15. A portable apparatus comprising:

a display;

a display sensor configured to detect a movement or a rotation of the display;

a sound processing part configured to process an audio signal so as to localize a sound image in a position outside a head of a listener; and an operation controller configured to:

compute a positional relation between the display and the head of the listener in an actual viewing space by computing an output from the display sensor configured to detect the movement or the rotation of the display to obtain at least one of (a) a moving direction and a moving distance of the display with respect to the head of the listener, and (b) a rotation direction and a rotation angle of the display with respect to the head of the listener, and control the localization of the sound image by the sound processing part in accordance with a result of the computation of the positional relation between the display and the head of the listener in the actual viewing space so that the computed positional relation between the display and the head of the listener is mapped as a positional relation between an image display surface and the head of the listener in a virtual viewing space.

16. The portable apparatus according to claim 15, wherein the operation controller is configured to:

receive information on a movement or a rotation of the head of the listener;

compute, based on the output from the display sensor and the information on the movement or the rotation of the head of the listener, the moving direction and the moving distance, or the rotation direction and the rotation angle of the display, and the moving direction and the moving distance, or the rotation direction and the rotation angle of the head of the listener; and control the sound processing performed by the sound processing part in accordance with a result of the computation so that the positional relation between the display and the head of the listener is mapped as the positional relation between the image display surface and the head of the listener in the virtual viewing space.

17. The portable apparatus according to claim 16, wherein the operation controller is configured to receive the information on the movement or the rotation of the head of the listener from at least one transducer unit.

18. The portable apparatus according to claim 17, wherein the at least one transducer unit comprises an earphone unit or a headphone unit.

19. The portable apparatus according to claim 15, wherein the portable apparatus comprises an information processing unit comprising the display, the display sensor, the sound processing part, and the operation controller.

20. The portable apparatus according to claim 15, wherein the portable apparatus comprises:

a display unit comprising the display and the display sensor; and an information processing unit comprising the sound processing part and the operation controller.

21. The portable apparatus according to claim 15, wherein the portable apparatus comprises a hand-held apparatus.

22. The portable apparatus according to claim 21, wherein the hand-held apparatus comprises a mobile phone.

* * * * *